US011447893B2

(12) United States Patent
Cook et al.

(10) Patent No.: US 11,447,893 B2
(45) Date of Patent: Sep. 20, 2022

(54) MELTBLOWN DIE TIP ASSEMBLY AND METHOD

(71) Applicant: Extrusion Group, LLC, Roswell, GA (US)

(72) Inventors: Michael Charles Cook, Marietta, GA (US); Kurtis Lee Brown, Alpharetta, GA (US); Micheal Troy Houston, Roswell, GA (US)

(73) Assignee: Extrusion Group, LLC, Roswell, GA (US)

( * ) Notice: Subject to any disclaimer, the term of this patent is extended or adjusted under 35 U.S.C. 154(b) by 477 days.

(21) Appl. No.: 16/198,703

(22) Filed: Nov. 21, 2018

(65) Prior Publication Data

US 2019/0153622 A1 May 23, 2019

Related U.S. Application Data

(60) Provisional application No. 62/590,037, filed on Nov. 22, 2017.

(51) Int. Cl.
*D01D 4/02* (2006.01)
*D01D 5/098* (2006.01)

(52) U.S. Cl.
CPC ..... *D01D 4/025* (2013.01); *D01D 5/0985* (2013.01)

(58) Field of Classification Search
CPC ..... D01D 4/025; D01D 5/02985
See application file for complete search history.

(56) References Cited

U.S. PATENT DOCUMENTS 3,016,599 A 1/1962 Perry, Jr.
3,268,954 A 8/1966 Joa
(Continued)

FOREIGN PATENT DOCUMENTS

CN 1375579 A 10/2002
CN 1375580 A 10/2002
(Continued)

OTHER PUBLICATIONS

*Kimberly-Clark Corporation; and Kimberly-Clark Global Sales, LLC* v. *Extrusion Group, LLC; Extrusion Group Services LLC; EG Global, LLC; EG Ventures, LLC; Michael Houston; and Michael Cook*, Civil Action No. 1:18-CV-04754; USDC, Northern District of Georgia, Complaint for Patent Infringement, Trade Secret Misappropriation, and Breach of Contract filed Oct. 15, 2018.
(Continued)

*Primary Examiner* — Galen H Hauth
(74) *Attorney, Agent, or Firm* — Foley & Lardner LLP

(57) ABSTRACT

This disclosure describes meltblown methods, assemblies, and systems for polymer production. In one such implementation, a meltblown system provides improved uniform output and reduction of fiber size given certain polymer material and production rate. In certain meltblown implementations, the equipment may be ready and quickly swapped while provided in hot standby mode such that the maintenance down time is minimized. The disclosed meltblown equipment may include a polymer beam and air chamber and a die tip assembly. The die tip assembly, in certain embodiments, may quickly be attached onto or removed from the polymer beam and air chamber. In preferred embodiments, the meltblown system includes a single input (e.g., a specific type of polymer material). The meltblown system includes some tapered structures that facilitate polymer flow. The assembly mechanisms used in the melt-
(Continued)

blown system enables cleaning of the polymer distribution components with each use.

45 Claims, 22 Drawing Sheets

(56) References Cited

U.S. PATENT DOCUMENTS 3,338,992 A 8/1967 Kinney
3,341,394 A 9/1967 Kinney
3,379,811 A 4/1968 Hartmann et al.
3,502,763 A 3/1970 Hartmann
3,538,551 A 11/1970 Joa
3,542,615 A 11/1970 Dobo et al.
3,606,175 A 9/1971 Appel et al.
3,617,439 A 11/1971 Chapman, Jr.
3,637,146 A 1/1972 Banks
3,673,021 A 6/1972 Joa
3,692,618 A 9/1972 Oskar et al.
3,692,622 A 9/1972 Dunning
3,704,198 A 11/1972 Prentice
3,755,527 A 8/1973 Keller et al.
3,764,451 A 10/1973 Dunning
3,768,118 A 10/1973 Ruffo et al.
3,793,678 A 2/1974 Appel
3,802,817 A 4/1974 Matsuki et al.
3,825,379 A 7/1974 Lohkamp et al.
3,825,380 A 7/1974 Harding et al.
3,825,381 A 7/1974 Dunning et al.
3,837,988 A 9/1974 Hennen et al.
3,849,241 A 11/1974 Butin et al.
3,865,535 A 2/1975 Langdon et al.
3,895,089 A 7/1975 Goyal
3,936,262 A 2/1976 Hehl
3,949,035 A 4/1976 Dunning et al.
3,954,361 A 5/1976 Page
3,959,421 A 5/1976 Weber et al.
3,966,126 A 6/1976 Werner
3,970,417 A 7/1976 Page
3,971,373 A 7/1976 Braun
3,976,734 A 8/1976 Dunning et al.
3,978,185 A 8/1976 Buntin et al.
3,981,650 A 9/1976 Page
4,041,203 A 8/1977 Brock et al.
4,100,324 A 7/1978 Anderson
4,118,531 A 10/1978 Hauser
4,241,881 A 12/1980 Laumer
4,315,347 A 2/1982 Austin et al.
4,340,563 A 7/1982 Appel et al.
4,375,448 A 3/1983 Appel et al.
4,380,570 A 4/1983 Schwarz
4,426,417 A 1/1984 Meitner et al.
4,436,780 A 3/1984 Hotchkiss et al.
4,486,161 A 12/1984 Middleton
4,526,733 A 7/1985 Lau
4,528,239 A 7/1985 Trokhan
4,588,635 A 5/1986 Donovan
4,622,259 A 11/1986 McAmish et al.
4,623,576 A 11/1986 Lloyd et al.
4,650,127 A 3/1987 Radwanski et al.
4,650,481 A 3/1987 O'Connor et al.
4,655,757 A 4/1987 McFarland et al.
4,659,609 A 4/1987 Lamers et al.
4,663,220 A 5/1987 Wisneski et al.
4,666,621 A 5/1987 Clark et al.
4,714,647 A 12/1987 Shipp et al.
4,720,252 A 1/1988 Appel et al.
4,724,114 A 2/1988 MacFarland
4,741,941 A 5/1988 Englebert et al.
4,767,586 A 8/1988 Radwanski et al.
4,784,892 A 11/1988 Storey et al.
4,786,550 A 11/1988 McFarland et al.
4,789,592 A 12/1988 Taniguchi et al.
4,795,668 A 1/1989 Krueger et al.
4,803,117 A 2/1989 Daponte
4,818,463 A 4/1989 Buehning
4,818,464 A 4/1989 Lau
4,820,572 A 4/1989 Killian et al.
4,826,415 A 5/1989 Mende
4,859,388 A 8/1989 Peterson et al.
4,889,476 A 12/1989 Buehning
4,906,513 A 3/1990 Kebbell et al.
4,923,454 A 5/1990 Seymour et al.
4,986,743 A 1/1991 Buehning
4,988,560 A 1/1991 Meyer et al.
5,043,207 A 8/1991 Donovan et al.
5,057,368 A 10/1991 Largman et al.
5,069,970 A 12/1991 Largman et al.
5,080,569 A 1/1992 Gubernick et al.
5,087,186 A 2/1992 Buehning
5,098,636 A 3/1992 Balk
5,108,820 A 4/1992 Kaneko et al.
5,128,082 A 7/1992 Makoui
5,145,689 A 9/1992 Allen et al.
5,160,746 A 11/1992 Dodge et al.
5,162,074 A 11/1992 Hills
5,195,684 A 3/1993 Radzins
5,196,207 A 3/1993 Koenig
5,236,641 A 8/1993 Allen et al.
5,248,247 A 9/1993 Rubhausen et al.
5,253,815 A 10/1993 Bowns et al.
5,268,106 A 12/1993 Allen et al.
5,269,670 A 12/1993 Allen et al.
5,273,565 A 12/1993 Milligan et al.
5,277,976 A 1/1994 Hogle et al.
5,298,694 A 3/1994 Thompson et al.
5,336,552 A 8/1994 Strack et al.
5,344,297 A 9/1994 Hills
5,350,370 A 9/1994 Jackson et al.
5,350,624 A 9/1994 Georger et al.
5,382,400 A 1/1995 Pike et al.
5,421,921 A 6/1995 Gill et al.
5,421,941 A 6/1995 Allen et al.
5,423,935 A 6/1995 Benecke et al.
5,435,708 A 7/1995 Kaun
5,445,509 A 8/1995 Allen et al.
5,446,100 A 8/1995 Durrance et al.
5,458,291 A 10/1995 Brusko et al.
5,466,410 A 11/1995 Hills
5,476,616 A 12/1995 Schwarz
5,492,751 A 2/1996 Butt et al.
5,498,463 A 3/1996 McDowall et al.
5,508,102 A 4/1996 Georger et al.
5,516,476 A 5/1996 Haggard et al.
5,527,178 A 6/1996 White et al.
5,539,056 A 7/1996 Yang et al.
5,540,332 A 7/1996 Kopacz et al.
5,580,581 A * 12/1996 Buehning ..... B29C 48/256 425/7
5,595,699 A 1/1997 Wright et al.
5,596,052 A 1/1997 Resconi et al.
5,601,851 A 2/1997 Terakawa
5,605,706 A 2/1997 Allen et al.
5,605,720 A 2/1997 Allen et al.
5,607,701 A 3/1997 Allen et al.
5,618,566 A 4/1997 Allen et al.
5,620,779 A 4/1997 Levy et al.
5,628,876 A 5/1997 Ayers et al.
5,632,938 A 5/1997 Buehning, Sr.
5,635,290 A 6/1997 Stopper et al.
5,639,541 A 6/1997 Adam
5,652,048 A 7/1997 Haynes et al.
5,658,639 A 8/1997 Curro et al.
5,665,278 A 9/1997 Allen et al.
5,667,635 A 9/1997 Win et al.
5,667,749 A 9/1997 Lau et al.
5,679,042 A 10/1997 Varona
5,679,379 A 10/1997 Fabbricante et al.
5,698,298 A 12/1997 Jackson et al.
5,707,468 A 1/1998 Arnold et al.
5,711,970 A 1/1998 Lau et al.
5,720,832 A 2/1998 Minto et al.
5,725,812 A 3/1998 Choi
5,728,219 A 3/1998 Allen et al.

(56) References Cited

U.S. PATENT DOCUMENTS 5,733,581 A 3/1998 Barboza et al.
5,744,007 A 4/1998 Trokhan et al.
5,772,952 A 6/1998 Allen et al.
5,773,375 A 6/1998 Swan et al.
5,807,795 A 9/1998 Lau et al.
5,811,178 A 9/1998 Adam et al.
5,814,349 A 9/1998 Geus et al.
5,834,385 A 11/1998 Blaney et al.
5,851,562 A 12/1998 Haggard et al.
5,858,515 A 1/1999 Stokes et al.
5,882,573 A 3/1999 Kwok et al.
5,888,524 A 3/1999 Cole
5,891,482 A 4/1999 Choi
5,902,540 A 5/1999 Kwok
5,904,298 A 5/1999 Kwok et al.
5,913,329 A 6/1999 Haynes et al.
5,916,661 A 6/1999 Benson et al.
5,932,316 A 8/1999 Cree et al.
5,935,883 A 8/1999 Pike
5,948,710 A 9/1999 Pomplun et al.
5,952,251 A 9/1999 Jackson et al.
5,964,351 A 10/1999 Zander
5,964,742 A 10/1999 McCormack et al.
5,974,631 A 11/1999 Leifeld
5,976,427 A 11/1999 Choi
5,993,943 A 11/1999 Bodaghi et al.
6,001,303 A 12/1999 Haynes et al.
6,018,018 A 1/2000 Samuelson et al.
6,028,018 A 2/2000 Amundson et al.
6,030,331 A 2/2000 Zander
6,074,597 A 6/2000 Kwok et al.
6,093,665 A 7/2000 Sayovitz et al.
6,117,379 A 9/2000 Haynes et al.
6,129,801 A 10/2000 Benson et al.
6,139,308 A 10/2000 Berrigan et al.
6,146,580 A 11/2000 Bontaites, Jr.
6,158,614 A 12/2000 Haines et al.
6,182,732 B1 2/2001 Allen
6,183,670 B1 2/2001 Torobin et al.
6,200,669 B1 3/2001 Marmon et al.
6,210,141 B1 4/2001 Allen
6,220,843 B1 4/2001 Allen
6,223,398 B1 5/2001 Leifeld
6,241,503 B1 6/2001 Wright et al.
6,269,969 B1 8/2001 Huang et al.
6,269,970 B1 8/2001 Huang et al.
6,273,359 B1 8/2001 Newman et al.
6,296,463 B1 10/2001 Allen
6,296,936 B1 10/2001 Yahiaoui et al.
6,315,806 B1 11/2001 Torobin et al.
6,319,342 B1 11/2001 Riddell
6,319,865 B1 11/2001 Mikami
6,336,801 B1 1/2002 Fish et al.
6,344,102 B1 2/2002 Wagner
6,364,647 B1 4/2002 Sanborn
6,378,784 B1 4/2002 Allen et al.
6,379,770 B2 4/2002 Vair et al.
6,417,120 B1 7/2002 Mitchler et al.
6,422,428 B1 7/2002 Allen et al.
6,422,848 B1 7/2002 Allen et al.
6,427,745 B1 8/2002 Allen
6,440,437 B1 8/2002 Krzysik et al.
6,454,989 B1 9/2002 Neely et al.
6,461,133 B1 10/2002 Lake et al.
6,471,910 B1 10/2002 Haggard et al.
6,474,967 B1 * 11/2002 Haynes ..... D01D 1/106 425/131.5
6,491,507 B1 12/2002 Allen
6,500,563 B1 12/2002 Datta et al.
6,502,615 B1 1/2003 Allen
6,524,521 B1 2/2003 Kuroiwa et al.
6,540,831 B1 4/2003 Craine et al.
6,565,344 B2 5/2003 Bentley et al.
6,572,033 B1 6/2003 Pullagura et al.
6,579,084 B1 6/2003 Cook
6,585,838 B1 7/2003 Mullins et al.
6,596,205 B1 7/2003 Choi
6,599,985 B2 7/2003 Fujii et al.
6,613,268 B2 9/2003 Haynes et al.
6,660,129 B1 12/2003 Cabell et al.
6,680,265 B1 1/2004 Smith et al.
6,739,024 B1 5/2004 Wagner
6,750,166 B1 6/2004 Etzold et al.
6,770,156 B2 8/2004 Allen
6,773,648 B2 8/2004 Luo et al.
6,773,656 B2 8/2004 Kannari et al.
6,784,125 B1 8/2004 Yamakawa et al.
6,796,010 B2 9/2004 Noelle
6,800,226 B1 10/2004 Gerking
6,803,009 B2 10/2004 Morman et al.
6,803,013 B2 10/2004 Fish et al.
6,811,638 B2 11/2004 Close et al.
6,824,372 B2 11/2004 Berrigan et al.
6,824,733 B2 11/2004 Erickson et al.
6,836,937 B1 1/2005 Boscolo
6,858,057 B2 2/2005 Healey
6,861,025 B2 3/2005 Erickson et al.
6,863,960 B2 3/2005 Curro et al.
6,867,156 B1 3/2005 White et al.
6,874,203 B2 4/2005 Bauersachs
6,918,750 B2 7/2005 Geus et al.
6,932,590 B2 8/2005 Geus et al.
6,946,413 B2 9/2005 Lange et al.
6,972,104 B2 * 12/2005 Haynes ..... D01D 4/025 264/211.14
6,989,193 B2 1/2006 Haile et al.
6,992,159 B2 1/2006 Datta et al.
7,004,738 B2 2/2006 Becker et al.
7,008,207 B2 3/2006 Bansal et al.
7,018,188 B2 3/2006 James et al.
7,056,112 B2 6/2006 Ulcej
7,081,299 B2 7/2006 Richeson
7,105,609 B2 9/2006 Datta et al.
7,150,616 B2 12/2006 Haynes et al.
7,160,091 B2 1/2007 Baumeister
7,168,932 B2 1/2007 Lassig et al.
7,176,150 B2 2/2007 Kopacz et al.
7,179,412 B1 2/2007 Wilkie et al.
7,192,550 B2 3/2007 Berger et al.
7,255,759 B2 8/2007 Debyser et al.
7,261,936 B2 8/2007 Davis et al.
7,285,504 B2 10/2007 Jones et al.
7,300,530 B2 11/2007 Bouchette et al.
7,316,552 B2 1/2008 Haynes et al.
7,320,821 B2 1/2008 Prodoehl
7,374,416 B2 5/2008 Cook et al.
7,438,544 B2 10/2008 Glawion et al.
7,455,800 B2 11/2008 Ferencz et al.
7,468,335 B2 12/2008 Imes et al.
7,501,085 B2 3/2009 Bodaghi et al.
7,504,062 B2 3/2009 Locher et al.
7,604,770 B2 10/2009 Wedell et al.
7,628,941 B2 12/2009 Krause et al.
7,732,357 B2 6/2010 Annis et al.
7,762,800 B2 7/2010 Geus et al.
7,837,009 B2 11/2010 Gross et al.
7,837,814 B2 11/2010 Minami et al.
7,989,371 B2 8/2011 Angadjivand et al.
8,012,565 B2 9/2011 Luo
8,017,534 B2 9/2011 Harvey et al.
8,029,723 B2 10/2011 Angadjivand et al.
8,088,316 B2 1/2012 Muth et al.
8,143,177 B2 3/2012 Noda et al.
8,231,370 B2 7/2012 Maas et al.
8,287,677 B2 10/2012 Lake et al.
8,357,256 B2 1/2013 Dumas et al.
8,404,348 B2 3/2013 Kokko et al.
8,408,889 B2 4/2013 Schutt et al.
8,512,626 B2 8/2013 Johnson et al.
8,585,387 B2 11/2013 Oyamada et al.
8,591,213 B2 11/2013 Fare'
8,591,683 B2 11/2013 Fox et al.
8,685,870 B2 4/2014 Austin et al.
8,802,002 B2 8/2014 Berrigan et al.

(56) References Cited

U.S. PATENT DOCUMENTS

| | | | |
|---|---|---|---|
| 8,870,559 | B2 | 10/2014 | Oyamada et al. |
| 8,968,614 | B2 | 3/2015 | Desai et al. |
| 9,062,398 | B2 | 6/2015 | Chou et al. |
| 9,194,060 | B2 | 11/2015 | Westwood |
| 9,205,006 | B2 | 12/2015 | Cheng et al. |
| 9,249,527 | B2 | 2/2016 | Lee et al. |
| 9,260,799 | B1 | 2/2016 | Tao |
| 9,260,800 | B1 | 2/2016 | Tao |
| 9,260,808 | B2 | 2/2016 | Schmidt et al. |
| 9,309,612 | B2 | 4/2016 | Brown et al. |
| 9,322,114 | B2 | 4/2016 | MacDonald et al. |
| 9,382,643 | B2 | 7/2016 | Moore et al. |
| 9,404,207 | B2 | 8/2016 | Matsubara et al. |
| 9,481,954 | B2 | 11/2016 | Terakawa et al. |
| 9,546,439 | B2 | 1/2017 | Coates et al. |
| 9,587,329 | B2 | 3/2017 | Choi |
| 9,617,658 | B2 | 4/2017 | Boscolo |
| 9,631,321 | B2 | 4/2017 | Brennan et al. |
| 9,944,047 | B2 | 4/2018 | Burt et al. |
| 2001/0026815 | A1 | 10/2001 | Suetomi |
| 2002/0053390 | A1 | 5/2002 | Allen |
| 2002/0094352 | A1 | 7/2002 | Guo |
| 2002/0125601 | A1 | 9/2002 | Allen |
| 2002/0155776 | A1 | 10/2002 | Mitchler et al. |
| 2003/0057613 | A1 | 3/2003 | Bansal et al. |
| 2003/0114067 | A1 | 6/2003 | Matela et al. |
| 2003/0162457 | A1 | 8/2003 | Berrigan et al. |
| 2003/0200991 | A1 | 10/2003 | Keck et al. |
| 2003/0203694 | A1 | 10/2003 | Deka et al. |
| 2003/0211802 | A1 | 11/2003 | Keck et al. |
| 2004/0045687 | A1 | 3/2004 | Shannon et al. |
| 2005/0042964 | A1 | 2/2005 | Sommer et al. |
| 2005/0043489 | A1 | 2/2005 | Datta et al. |
| 2005/0133971 | A1 | 6/2005 | Haynes et al. |
| 2005/0136772 | A1 | 6/2005 | Chen et al. |
| 2005/0136781 | A1 | 6/2005 | Lassig et al. |
| 2005/0148260 | A1 | 7/2005 | Kopacz et al. |
| 2005/0148261 | A1 | 7/2005 | Close et al. |
| 2006/0061006 | A1 | 3/2006 | Frey et al. |
| 2006/0172647 | A1 | 8/2006 | Mehta et al. |
| 2007/0026753 | A1 | 2/2007 | Neely et al. |
| 2007/0049153 | A1 | 3/2007 | Dunbar et al. |
| 2007/0065643 | A1 | 3/2007 | Kopacz et al. |
| 2007/0090555 | A1 | 4/2007 | Roettger et al. |
| 2007/0098768 | A1 | 5/2007 | Close et al. |
| 2007/0148447 | A1 | 6/2007 | Amundson et al. |
| 2007/0197117 | A1 | 8/2007 | Austin et al. |
| 2007/0202769 | A1 | 8/2007 | Groner et al. |
| 2007/0205530 | A1 | 9/2007 | Thompson |
| 2008/0076315 | A1 | 3/2008 | McCormack et al. |
| 2008/0095970 | A1 | 4/2008 | Takashima et al. |
| 2008/0132866 | A1 | 6/2008 | Siqueira et al. |
| 2008/0203602 | A1 | 8/2008 | Riedel et al. |
| 2008/0315454 | A1 | 12/2008 | Angadjivand et al. |
| 2009/0120048 | A1 | 5/2009 | Wertz et al. |
| 2009/0233049 | A1 | 9/2009 | Jackson et al. |
| 2010/0029164 | A1 | 2/2010 | Datta et al. |
| 2010/0048082 | A1 | 2/2010 | Topolkaraev et al. |
| 2010/0266818 | A1 | 10/2010 | Westwood et al. |
| 2010/0324515 | A1 | 12/2010 | Boscolo |
| 2011/0037194 | A1 | 2/2011 | James |
| 2011/0045261 | A1 | 2/2011 | Sellars |
| 2011/0104493 | A1 | 5/2011 | Barnholtz et al. |
| 2011/0151196 | A1 | 6/2011 | Schmidt et al. |
| 2011/0155338 | A1 | 6/2011 | Zhang et al. |
| 2011/0159265 | A1 | 6/2011 | Hurley et al. |
| 2012/0066855 | A1 | 3/2012 | Schmidt et al. |
| 2012/0144611 | A1 | 6/2012 | Baker et al. |
| 2012/0149273 | A1 | 6/2012 | Moore et al. |
| 2012/0171919 | A1 | 7/2012 | Jackson et al. |
| 2012/0238169 | A1 | 9/2012 | Mason et al. |
| 2012/0274003 | A1 | 11/2012 | Conrad et al. |
| 2013/0122771 | A1 | 5/2013 | Matsubara et al. |
| 2013/0189892 | A1 | 7/2013 | Boscolo |
| 2014/0170402 | A1 | 6/2014 | Knowlson et al. |
| 2014/0308486 | A1 | 10/2014 | Butsch et al. |
| 2014/0316362 | A1 | 10/2014 | Fiebig et al. |
| 2015/0152571 | A1 | 6/2015 | Otani et al. |
| 2015/0211158 | A1 | 7/2015 | Hassan et al. |
| 2016/0002825 | A1 | 1/2016 | Cinquemani et al. |
| 2016/0040337 | A1 | 2/2016 | Dutkiewicz et al. |
| 2016/0136924 | A1 | 5/2016 | Lee et al. |
| 2016/0215422 | A1 | 7/2016 | Rademacker et al. |
| 2016/0221300 | A1 | 8/2016 | Sommer et al. |
| 2017/0114483 | A1 | 4/2017 | Boscolo |
| 2017/0121863 | A1 | 5/2017 | Gabler |

FOREIGN PATENT DOCUMENTS

| | | | |
|---|---|---|---|
| CN | 1607269 | A | 4/2005 |
| CN | 1898420 | A | 1/2007 |
| CN | 101029433 | A | 9/2007 |
| CN | 201165568 | Y | 12/2008 |
| CN | 201224821 | Y | 4/2009 |
| CN | 201428047 | Y | 3/2010 |
| CN | 101709534 | A | 5/2010 |
| CN | 101250761 | B | 10/2010 |
| CN | 101880942 | B | 11/2010 |
| CN | 101652509 | B | 7/2011 |
| CN | 101982600 | B | 1/2012 |
| CN | 202298095 | U | 7/2012 |
| CN | 202359338 | U | 8/2012 |
| CN | 202671824 | U | 1/2013 |
| CN | 202744675 | U | 2/2013 |
| CN | 202865547 | U | 4/2013 |
| CN | 203030116 | U | 7/2013 |
| CN | 203034226 | U | 7/2013 |
| CN | 203049208 | U | 7/2013 |
| CN | 102390074 | B | 9/2013 |
| CN | 102407552 | B | 9/2013 |
| CN | 203212803 | U | 9/2013 |
| CN | 102691135 | B | 10/2013 |
| CN | 203303753 | U | 11/2013 |
| CN | 203320250 | U | 12/2013 |
| CN | 102127842 | B | 7/2014 |
| CN | 203782356 | U | 8/2014 |
| CN | 203991115 | U | 12/2014 |
| CN | 102787374 | B | 2/2015 |
| CN | 103015039 | B | 2/2015 |
| CN | 104358024 | A | 2/2015 |
| CN | 103009768 | B | 3/2015 |
| CN | 103009779 | B | 3/2015 |
| CN | 204199080 | U | 3/2015 |
| CN | 103706343 | B | 4/2015 |
| CN | 204237975 | U | 4/2015 |
| CN | 204246954 | U | 4/2015 |
| CN | 103184540 | B | 5/2015 |
| CN | 204325695 | U | 5/2015 |
| CN | 104727015 | A | 6/2015 |
| CN | 103451754 | B | 8/2015 |
| CN | 103469317 | B | 10/2015 |
| CN | 103014900 | B | 11/2015 |
| CN | 105013248 | A | 11/2015 |
| CN | 103161032 | B | 12/2015 |
| CN | 105133062 | A | 12/2015 |
| CN | 105297288 | A | 2/2016 |
| CN | 205046307 | U | 2/2016 |
| CN | 105420860 | A | 3/2016 |
| CN | 103046230 | B | 4/2016 |
| CN | 105525436 | A | 4/2016 |
| CN | 205185492 | U | 4/2016 |
| CN | 105568446 | A | 5/2016 |
| CN | 105568560 | A | 5/2016 |
| CN | 105586717 | A | 5/2016 |
| CN | 103510164 | B | 6/2016 |
| CN | 104264237 | B | 6/2016 |
| CN | 205344053 | U | 6/2016 |
| CN | 105780297 | B | 7/2016 |
| CN | 105803541 | A | 7/2016 |
| CN | 103261503 | B | 9/2016 |
| CN | 106048742 | A | 10/2016 |
| CN | 205662683 | U | 10/2016 |
| CN | 104246045 | B | 11/2016 |
| CN | 205821651 | U | 12/2016 |

(56) References Cited

FOREIGN PATENT DOCUMENTS

| | | | |
|---|---|---|---|
| CN | 106381613 | A | 2/2017 |
| CN | 206027248 | U | 3/2017 |
| CN | 106555236 | A | 4/2017 |
| CN | 106555257 | A | 4/2017 |
| CN | 106555276 | A | 4/2017 |
| CN | 206070124 | U | 4/2017 |
| CN | 106757771 | A | 5/2017 |
| CN | 206173594 | U | 5/2017 |
| CN | 106835417 | A | 6/2017 |
| CN | 105239175 | B | 7/2017 |
| CN | 106930003 | A | 7/2017 |
| CN | 106958079 | A | 7/2017 |
| CN | 104589523 | B | 8/2017 |
| CN | 106995983 | A | 8/2017 |
| CN | 107059246 | A | 8/2017 |
| CN | 107109741 | A | 8/2017 |
| CN | 107217392 | A | 9/2017 |
| CN | 107217393 | A | 9/2017 |
| CN | 206457605 | U | 9/2017 |
| CN | 206475548 | U | 9/2017 |
| CN | 206477111 | U | 9/2017 |
| CN | 206477112 | U | 9/2017 |
| CN | 206495044 | U | 9/2017 |
| CN | 206512388 | U | 9/2017 |
| CN | 206512389 | U | 9/2017 |
| CN | 105803668 | B | 10/2017 |
| CN | 105803683 | B | 10/2017 |
| CN | 107237046 | A | 10/2017 |
| CN | 206623256 | U | 11/2017 |
| CN | 104626510 | B | 12/2017 |
| CN | 105063892 | B | 12/2017 |
| CN | 105696192 | B | 12/2017 |
| CN | 107447372 | A | 12/2017 |
| CN | 107501986 | A | 12/2017 |
| CN | 206768289 | U | 12/2017 |
| CN | 105002660 | B | 1/2018 |
| CN | 105369365 | B | 1/2018 |
| CN | 106012299 | B | 1/2018 |
| CN | 106012301 | B | 1/2018 |
| CN | 107550835 | A | 1/2018 |
| CN | 107574583 | A | 1/2018 |
| CN | 206858772 | U | 1/2018 |
| CN | 206928050 | U | 1/2018 |
| CN | 206938146 | U | 1/2018 |
| CN | 106012300 | B | 2/2018 |
| CN | 106087248 | B | 2/2018 |
| CN | 107708637 | A | 2/2018 |
| EP | 0 891 06 | B1 | 4/1987 |
| EP | 4 744 21 | A2 | 3/1992 |
| EP | 4 744 22 | A2 | 3/1992 |
| EP | 6 333 39 | A2 | 1/1995 |
| EP | 7 010 10 | A1 | 3/1996 |
| EP | 9 873 52 | A2 | 3/2000 |
| EP | 8 661 52 | B1 | 11/2002 |
| EP | 1 270 770 | A2 | 1/2003 |
| EP | 1 302 592 | A1 | 4/2003 |
| EP | 8 220 53 | B1 | 6/2003 |
| EP | 2 167 714 | B1 | 10/2011 |
| JP | 54-103466 | A | 8/1979 |
| KR | 10-2004-0009721 | A | 1/2004 |
| WO | 00/79034 | A1 | 12/2000 |
| WO | 02/42043 | A1 | 5/2002 |
| WO | WO-02/38846 | A2 | 5/2002 |
| WO | WO-03/006735 | A1 | 1/2003 |
| WO | WO-2004/061181 | A1 | 7/2004 |
| WO | WO-2015/165272 | A1 | 11/2015 |
| WO | WO-2016/098157 | A1 | 6/2016 |
| WO | WO-2017/028421 | A1 | 2/2017 |
| WO | WO-2017/057028 | A1 | 4/2017 |
| WO | WO-2017/113574 | A1 | 7/2017 |
| WO | WO-2017/130784 | A1 | 8/2017 |
| WO | WO-2017/151676 | A1 | 9/2017 |
| WO | WO-2017/206177 | A1 | 12/2017 |
| WO | WO-2018/045041 | A1 | 3/2018 |
| WO | WO-2018/091453 | A1 | 5/2018 |

OTHER PUBLICATIONS

*Kimberly-Clark Corporation; and Kimberly-Clark Global Sales, LLC* v. *Extrusion Group, LLC; Extrusion Group Services LLC; EG Global, LLC; EG Ventures, LLC; Michael Houston; and Michael Cook*, Civil Action No. 1:18-CV-04754; USDC, Northern District of Georgia, Answer filed Nov. 29, 2018.

*Kimberly-Clark Corporation; and Kimberly-Clark Global Sales, LLC* v. *Extrusion Group, LLC; Extrusion Group Services LLC; EG Global, LLC; EG Ventures, LLC; Michael Houston; and Michael Cook*, Civil Action No. 1:18-CV-04754; USDC, Northern District of Georgia, First Amended Complaint for Patent Infringement, Trade Secret Misappropriation, and Breach of Contract filed Nov. 13, 2019.

*Kimberly-Clark Corporation; and Kimberly-Clark Global Sales, LLC* v. *Extrusion Group, LLC; Extrusion Group Services LLC; EG Global, LLC; EG Ventures, LLC; Michael Houston; and Michael Cook*, Civil Action No. 1:18-CV-04754; USDC, Northern District of Georgia, Answers, Affirmative Defenses, and Counterclaims to First Amended Complaint filed Dec. 4, 2019.

*Kimberly-Clark Corporation; and Kimberly-Clark Global Sales, LLC* v. *Extrusion Group, LLC; Extrusion Group Services LLC; EG Global, LLC; EG Ventures, LLC; Michael Houston; and Michael Cook*, Civil Action No. 1:18-CV-04754; USDC, Northern District of Georgia, Docket Report dated Dec. 10, 2019.

PCT International Application No. PCT/US2018/062345, International Search Report and Written Opinion, dated Jan. 31, 2019, 13 pgs.

Foreign Search Report on EP 18881033.7 dated Sep. 8, 2021.

* cited by examiner

MELTBLOWN DIE TIP ASSEMBLY AND METHOD

CROSS REFERENCE AND PRIORITY CLAIM TO PROVISIONAL APPLICATION

This application claims the benefits and priority of the U.S. Provisional Patent Application No. 62/590,037 filed on Nov. 22, 2017, the entire contents of which are incorporated herein by reference for all purposes.

FIELD

This disclosure relates to meltblown equipment, meltblown products, and fabrication methods.

BACKGROUND

Nonwoven sheet products, such as, for example, vacuum bags, bath wipes, tea bag filters, are often made by a conventional fabrication method called melt blowing. The related production or manufacturing equipment may be referred to as meltblown equipment and the related products may be referred to as meltblown products. Typically, the fabrication method first melts a thermoplastic polymer into a liquid or flowable form, then extrudes the polymer through nozzles (also known as a die tip), and blows high speed and high temperature gases around the nozzles to fiberize the polymer and deposit the fiberized polymer on a surface, such as a substrate surface. The deposited polymer is allowed to cure and form a nonwoven fabric sheet. These nonwoven sheet products may be used in various applications, such as, for example, filtration, sorbents, apparels, and drug delivery applications.

Polymers having thermoplastic properties are suitable for melt blowing because of their characteristics in transition between the liquid and solid states. The transition temperature is known as glass transition temperature and varies from polymer to polymer. These polymers include, for example, polypropylene, polystyrene, polyesters, polyurethane, polyamides, polyethylene, and polycarbonate. Because these polymers have different glass transition temperatures and flow characteristics (e.g., viscosity, adhesiveness, etc.), meltblown equipment is often limited by their ability to produce products with certain uniformity, fiber size, or both. The polymer fiber uniformity is often limited by the uniformity of the high speed air surrounding the die tip. Furthermore, these specific limitations may lead to an overall limited production rate that caps productivity and economic viability of such products. The limitations are further magnified when two or more meltblown die tips are used together in a formation process involving wood pulp or other fibers, such as in a multiform process.

SUMMARY

This disclosure describes melt blowing methods, assemblies, and systems that, in certain implementations, may improve one or more of product uniformity, fiber size, production rate, polymer production performance, and improved equipment and production operational efficiency. In one specific aspect, the disclosed meltblown die tip assembly produces more uniform high speed and high temperature airflows surrounding the die tip than traditional die tip assemblies. In certain implementations, the disclosed meltblown system produces more uniform output and reduced fiber sizes given certain polymer materials and production rates. More uniform output production efficiency may be achieved, in some implementations, through equipment design that allows for more thorough cleaning, and/or by having the equipment ready, such as on hot-standby, for replacement such that the maintenance down time can be lessened or minimized.

In general, the disclosed meltblown equipment includes a polymer beam and air chamber and a die tip assembly. The die tip assembly may be quickly attached, in certain implementations, onto or removed from the polymer beam and air chamber. The air chamber, along with an air feed system, may be included in an air heated beam for providing air to the die tip assembly. The air feed system can feed high velocity air though distribution holes to increase the heat transfer in the holes. The holes are located in locations to enable a corresponding structure (e.g., a plate) receiving the airflow to use the exiting air to increase the heat transfer efficiency. For example, the heat transfer efficiency may be increased on the die tip where airflow impinges, or at the air holes in the die tip, or both.

The die tip has airflows and drawn polymer converge at its nozzle, where highspeed uniform airflows of opposing sides entrain and draw out the polymer for fiberization. Because in certain implementations no fasteners or undesired obstructions are used in the airflow on polymer passageway or in or near the nozzle (as certain embodiments intentionally avoid such configurations with fasteners causing airflow obstructions), there is no disruption to the desired supply of air and/or polymer to the die tip nozzle. In particular, this disclosure shows an embodiment of a meltblown die tip structure that excludes any bolt head or countersink machined areas within approximately 10 cm (or 4") of the nozzle exterior surface or in the airflow channels or passageways of the interior of the die's machined areas. This greatly enhances production and product uniformity.

In certain embodiments, the meltblown system includes a single input (e.g., a polymer material). The meltblown system may include tapered structures that facilitate flow of the input. Such tapered structures may be referred to as polymer distribution components. The assembly mechanisms used in some embodiments of the disclosed meltblown systems enable more convenient and thorough cleaning of the polymer distribution components with each use than traditional polymer distribution components. For example, when a mounting plate is used with the polymer distribution components, a single polymer seal (e.g., a single round seal may be used instead of a number of round seals or an elongated gasket on a channel) may be used. This allows for ease of cleaning offline in assembly areas and a simple installation in the machine. When no mounting plate is used, cleaning can be performed, in certain implementations, using a bottom plate of an air chamber or from a bottom access of the meltblown beam.

In specific instances, the die tip assembly used in the disclosed meltblown system is replaceable or interchangeable with another replacement die tip assembly, in a manner similar to cartridge replacement in printers. In other instances, the die tip assembly has air output that includes two streams of air entrained at a sharp or otherwise desired angle for the improved ability in producing fine polymer fibers. This may be dependent on the type of polymers being used and/or the type or desired characteristics of the product being produced. In yet some other instances, the die tip assembly also provides novel geometric settings, such as a setback distance and tip to tip distances, as further explained in the detailed description.

The disclosure presents one or more implementations of the die tip assembly that may provide other advantages over existing meltblown devices and methods. For example, the disclosed die tip assembly may provide a more optimized use of heated air in an non-obstructed manner. The die tip assembly, in certain implementations, may be adapted to compact sizes depending on specific requirements, such that two or more die tip assemblies can be arranged together during production, for example, in a configuration for combining with pulp fibers. In certain embodiments, the die tip assembly has a weld-in or machined-in strength rib structure for providing good geometric stability (examples provided in FIGS. 4B-4D).

In a first general aspect, a meltblown die tip assembly includes a mounting structure having at least one polymer flow passageway formed therein. The mounting structure is configured to receive a polymer flow, a first air passageway formed therein and configured to receive a first airflow, and a second air passageway formed therein and configured to receive a second airflow. The meltblown die tip assembly further includes an elongated die tip having a polymer flow chamber, a polymer flow tip, a first airflow regulation channel having a first impingement surface, a second airflow regulation channel having a second impingement surface, a first angled side, and a second angled side. The polymer flow chamber of the elongated die tip is in fluid communication with the at least one polymer flow passageway of the mounting structure at a first opening of the polymer flow chamber of the elongated die tip. The polymer flow chamber is configured to receive at least a portion of the polymer flow from the at least one polymer flow passageway of the mounting structure. The polymer flow chamber of the elongated die tip is in fluid communication with the elongated die tip at a first opening.

The polymer flow chamber of the elongated die tip is configured to receive at least a portion of the polymer flow from a first opening, the polymer flow chamber of the elongated die tip in fluid communication with the polymer flow tip at a second opening. The polymer flow tip is configured to receive at least a portion of the polymer flow from the polymer flow chamber at the second opening. The polymer flow tip, which may be considered the second opening in certain implementations, has a tip opening configured to dispense at least a portion of the polymer flow. The first airflow regulation channel is configured to receive the first airflow from the first air passageway of the mounting structure, regulate the first airflow using at least the first impingement surface, and dispense the first airflow adjacent the first angled side of the elongated die tip. The second airflow regulation channel is configured to receive the second airflow from the second air passageway of the mounting structure, regulate the second airflow using at least the second impingement surface, and dispense the second airflow adjacent the second angled side.

The meltblown die tip assembly further includes a first air plate positioned at least partially adjacent the first angled side of the elongated die tip and configured to form a first air exit passageway that is configured to receive the first airflow dispensed from the first airflow regulation channel of the elongated die tip and to dispense the first airflow adjacent the tip opening of the polymer flow tip and the at least a portion of the polymer flow to at least partially entrain such first airflow with the polymer flow. The assembly also includes a second air plate positioned at least partially adjacent the second angled side of the elongated die tip and configured to form a second air exit passageway that is configured to receive the second airflow dispensed from the second airflow regulation channel of the elongated die tip and to dispense the second airflow adjacent the tip opening of the polymer flow tip and the at least a portion of the polymer flow to at least partially entrain such second airflow with the polymer flow.

In some embodiments, the elongated die tip includes an impingement portion housing the first airflow regulation channel and the second airflow regulation channel. The first air regulation channel has a first impingement surface. The second airflow regulation channel has a second impingement surface. The first impingement surface and the second impingement surface assist with regulating the first airflow and the second airflow respectively. For example, the first impingement surface impinges or disrupts the first airflow in its initial traveling direction and thus forces the airflow to turn and reorganize or reassemble. In addition, the impact between the first airflow and the first impingement surface aids a transfer of energy from the first airflow to the impingement portion and thus the die tip. For example, the first and the second airflows may enter the meltblown system at a high temperature for maintaining the liquidity state of the polymer flow. The impingement portion, such as the first and the second impingement surfaces, provides a mechanism for efficient heat transfer and regulation of the uniformity of the first and the second airflows. In other embodiments, there may be multiple impingement surfaces in the airflow regulation channels.

In some other embodiments, the elongated die tip includes a neck portion narrower than the impingement portion and obstructing airflows exiting the first airflow regulation channel and the second airflow regulation channel.

In yet some other embodiments, the impingement portion includes a plurality of fastenable holes for receiving fasteners affixing the first air plate and the second air plate to the impingement portion of the elongated die tip. This may be achieved, using horizontally, vertically, or diagonally oriented fasteners, or combinations of the same.

In some embodiments, the elongated die tip and the first and the second air plates form a replaceable cartridge.

In some other embodiments, the meltblown die tip assembly further includes at least one breaker plate governing polymer flow from the polymer flow passageway of the mounting structure into the polymer flow chamber. The at least one breaker plate includes a plurality of holes for filtering and regulating the polymer flow. The at least one breaker plate can, in some embodiments, include two stacked breaker plates having one or more screen filter positioned between the two stacked breaker plates.

In yet some other embodiments, the first air plate and the second air plate are mounted onto the mounting structure using one or more fasteners that may be parallel to the polymer flow chamber.

In some embodiments, the first airflow regulation channel is configured to receive the first airflow from the first air passageway of the mounting structure, regulate the first airflow, transfer heat from the first airflow to the elongated die tip, and dispense the first airflow adjacent the first angled side of the elongated die tip; and wherein the second airflow regulation channel is configured to receive the second airflow from the second air passageway of the mounting structure, regulate the second airflow, transfer heat from the second airflow to the elongated die tip, and dispense the second airflow adjacent the second angled side of the elongated die tip.

In some other embodiments, the first and the second airflows cause the die tip assembly to maintain a temperature that maintains the polymer flow in a liquid state.

In yet some other embodiments, the polymer flow tip has an external angle of about 50 to about 90 degrees.

In some embodiments, the mounting structure and the elongated die tip are a unified piece. For example, the mounting structure and the elongated die tip may be considered a unified piece when bolted together, welded together, or otherwise combined or mounted (e.g., by adhesive). In other instances, the mounting structure and the elongated die tip are manufactured as one piece, which would also be considered a unified piece.

In some other embodiments, the elongated die tip further comprises an angled tip, the first air plate further comprises a first tip, and the second air plate further comprises a second tip, such that a vertical distance between the angled tip and a midpoint of the first tip and the second tip defines a setback dimension being about 0.5 mm to about 4.0 mm. A distance between the first tip and the second tip defines a tip-to-tip distance, such that a ratio of the setback dimension and the tip-to-tip distance is about 0.25 to about 2.5.

In yet some other embodiments, the at least one polymer flow passageway of the mounting structure includes an opening width near the first opening of the polymer flow chamber such that cleaning tools can access internal surfaces of the at least one polymer flow passageway of the mounting structure. The internal surfaces of the at least one polymer flow passageway of the mounting structure includes a tapered top surface for distributing the polymer flow.

In some embodiments, the first air plate includes a first outer surface. The second air plate includes a second outer surface. The first outer surface and the second outer surface form an angle between about 90 and about 140 degrees.

In some other embodiments, the meltblown die tip assembly further includes a meltblown beam fluidly connected with the mounting structure for supplying air and polymer. The meltblown beam and the mounting structure form a height above the die tip such that no other obstacle interferes with the surrounding air of the die tip in a region of control. The meltblown beam and the mounting structure are one unified piece.

In yet some other embodiments, the first airflow and the second airflow are entrained at a tip apex drawing the polymer flow and surrounding air such that no interfering structure is present within at least about 38 mm of the tip apex.

In some embodiments, the polymer flow chamber of the elongated die tip includes a rib structure connecting a first side wall of the polymer flow chamber to a second, opposing, side wall of the polymer flow chamber, wherein the rib structure has a cross sectional fluid dynamic shape to promote laminar flow in the polymer flow.

In some other embodiments, the first impingement surface is located at a top surface of the elongated die tip.

In yet some other embodiments, the first impingement surface is located within the first airflow regulation channel.

In a second general aspect, a die tip for polymer flow and air entrainment, the die tip may include a body portion, a polymer flow chamber, a polymer flow tip, a first airflow regulation channel, a first angled side, a second airflow regulation channel, and a second angled side opposed to the first angled side, the first angled side and the second angled side are positioned adjacent to or define the polymer flow tip. The polymer flow chamber receives a polymer flow and is configured to deliver the polymer flow to the polymer flow tip. The first airflow regulation channel receives a first airflow provided to the first angled side at accelerated speeds. The body portion includes at least one impingement surface impinging the first airflow for regulating the first airflow. The first angled side is provided adjacent to or defines part of the polymer flow tip such that the first airflow at accelerated speeds helps to draw and blows out the polymer flow from the polymer flow tip.

In some embodiments, the body portion includes a neck portion reducing a width of the body portion such that a transition surface from the neck portion to the first angled side impedes the first airflow exiting the first airflow regulation channel. The at least one impingement surface may include the transition surface.

In some other embodiments, the first angled side is adjacent a first air plate for directing and accelerating the first airflow impeded by the transition surface. The first airflow heats up the body portion of the die tip when the airflow impinges the transition surface impinges the airflow and help transfer heat from the first and second air flows to the die tip. The second airflow regulation channel receives a second airflow and sends the second airflow to the second angled side. The body portion includes a second impingement surface impinging a second airflow for regulating the second airflow in the second air regulation channel. The second airflow may be accelerated to a substantially same level of speeds as the first airflow when reached at the polymer flow tip such that both the first airflow and the second airflow are entrained to draw and blow out the polymer from the polymer flow tip.

In yet some other embodiments, the first airflow and the second airflow entrain to draw the polymer flow and blow or pull the polymer flow out of the polymer flow tip. In certain implementations, the first airflow and the second airflow are not impeded by or in contact with any fastener when the first airflow travels from the first airflow regulation channel to reach the polymer flow tip and the second airflow travels from the second airflow regulation channel to reach the polymer flow tip. The first airflow and the second airflow are not impeded for at least about 38 mm away from the polymer flow tip.

In some embodiments, the first air plate further includes a first tip, and the second air plate further includes a second tip, such that a vertical distance between the polymer flow tip and a midpoint of the first tip and the second tip defines a setback dimension being about 0.5 mm to about 4.0 mm. A distance between the first tip and the second tip defines a tip-to-tip distance, such that a ratio of the setback dimension and the tip-to-tip distance is about 0.25 to 2.5.

In a third general aspect, a meltblown die tip assembly includes a mounting structure having a polymer flow conduit and an airflow conduit. The meltblown die tip assembly includes a die tip at least partially sealingly attached to the mounting structure. The die tip receives a polymer flow from the polymer flow conduit of the mounting structure and receives an airflow from the airflow conduit of the mounting structure. The die tip includes an impingement surface receiving and reflecting the airflow to force the airflow to at least partially reassemble. An air plate is sealingly attached to the mounting structure and is mounted adjacent the die tip for providing a passage to accelerate the airflow exiting the die tip. The accelerated airflow draws the polymer flow from the die tip and fiberizes the polymer flow as desired.

In some embodiments, the die tip includes a second impingement surface between the die tip and the air plate, or in the die tip.

In a fourth general aspect, a method is disclosed for producing uniform or more uniform meltblown products by providing mere uniform airflows to a meltblown system. The method includes feeding pressurized air into one or more air passageways in a mounting structure to form a first airflow.

The first airflow is impinged using a first impingement surface near an exit of the air passageway of the mounting structure. The first airflow impinged by the first impingement surface is then reassembled in a plenum or volume above or adjacent the first impingement surface. The reassembled first airflow passes into an air regulation channel. The reassembled first airflow is then accelerated to draw a polymer for melt blowing.

In some embodiments, the method further includes impinging the reassembled first airflow using a second impingement surface at a neck portion of a die tip and reassembling the first airflow impinged by the second impingement surface in a second plenum or volume above or adjacent the second impingement surface.

Detailed disclosure and examples are provided below.

BRIEF DESCRIPTION OF FIGURES

Like elements are labeled using like numerals.

DETAILED DESCRIPTION

This disclosure presents a meltblown system having a die tip assembly, and related meltblown methods capable of producing highly uniform meltblown materials. The meltblown system, in one or more embodiments, provides advanced operation in handling polymer materials that usually pose limitations to conventional meltblown machines and methods, such as, for example, in terms of fiber size, porosity, among others. The disclosed meltblown system, in certain embodiments for a given certain throughput (as measured by volume or mass per length per unit time), can produce uniform or more uniform polymer products having reduced fiber sizes, which is important to a desired product quality. The meltblown system may also provide several operational benefits, such as easy cleaning, rapid tool changing, uniform heating or cooling, uniform polymer flowing, and others. Details of one or more implementations of a meltblown system are described below.

Figure 1:
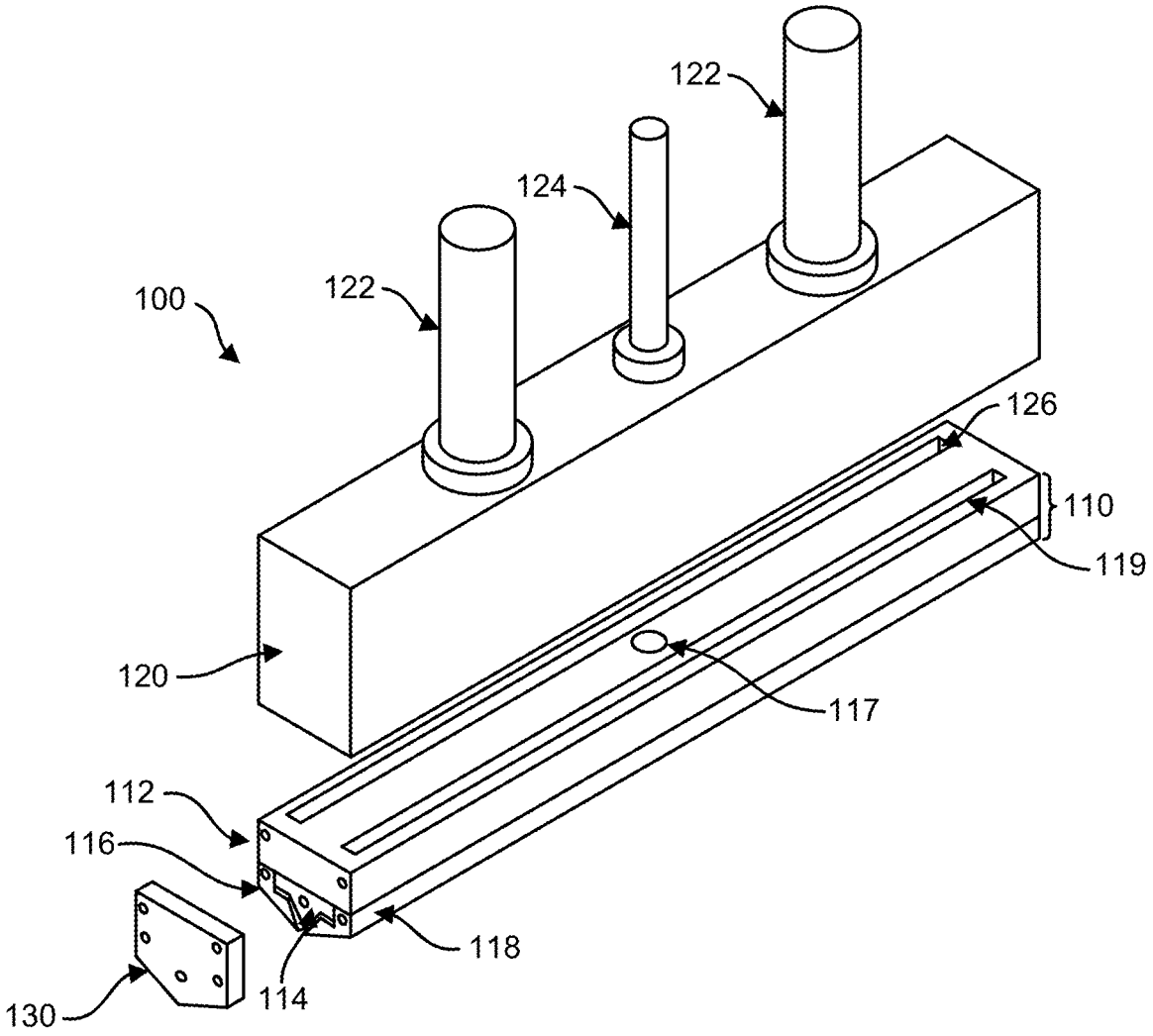
FIG. 1 is a perspective exploded view of a meltblown system.

FIG. 1 is a perspective exploded view of an embodiment of a meltblown system 100. The meltblown system 100 includes a die tip assembly 110, a meltblown beam 120, and one or more end plates 130. The meltblown beam 120 receives air from an external source from one or more conduits 122 and receives polymers in a liquid state from an external source via one or more conduits 124. Sources providing the air and polymers are well known in the art. The air, such as pressurized and/or heated air, is used to create a spray of liquid fibers of the liquid polymers. In the spray, long strings of fibers will land on a receiving surface or substrate and form a non-woven fabric sheet. This meltblowing process is achieved using the mechanisms inside the die tip assembly (also known as spinneret assembly) 110.

The die tip assembly 110 may include, in the example embodiment as shown, a mounting structure 112, a die tip 114, a first air plate 116, and a second air plate 118. The end plate 130 may assist with fastening these components of the die tip assembly 110 on an end. In some embodiments, another end plate (not shown) fastens certain components of the die tip assembly 110 on the other end. Specifically, the end plate 130 (as well as another end plate not shown) is fastenable to a frontal end of the elongated die tip 114, frontal ends of the two air plates 116 and 118, and a frontal end of the mounting structure 112 to have the assembly form a replacement cartridge such that the complete assembly can be quickly and conveniently replaced or exchanged while in hot standby mode without time-consuming dissembling of each component from the meltblown beam 120. The mounting structure 112 may include a polymer receiving conduit or hole 117 for receiving polymer from the beam 120. The mounting structure 112 also includes a slot or a number of holes 119 for receiving air. In some embodiments, the mounting structure includes two slots 119 and 126 positioned, in one implementation, symmetrically about the polymer receiving hole 117. Each of the slot 119 and 126 may include holes or conduits for providing air into the die tip assembly 110.

As further discussed below, the die tip 114 is assembled with the first air plate 116 and the second air plate 118 to create passages for airflow to accelerate to high speeds to perform the meltblowing process. The mounting structure 112 receives the polymer materials and air flow from the meltblown beam 120 and orderly feeds or directs them to the die tip 114 underneath. In some embodiments, the mounting structure 112 may be part of or integrated with the meltblown beam 120, and the die tip 114 and the first and the second air plates 116 and 118 are mounted below the mounting structure 112 of the meltblown beam 120. In some other embodiments, the mounting structure 112 may be part of the die tip 114 and receives the first and the second air plates 116 and 118. After assembly, the first air plate 116 and the second air plate 118 have a relatively large tip-to-tip distance. In some embodiments, the distance can be about 1.27 mm (or 0.05"), or in a range that includes such distance.

Figure 2A:
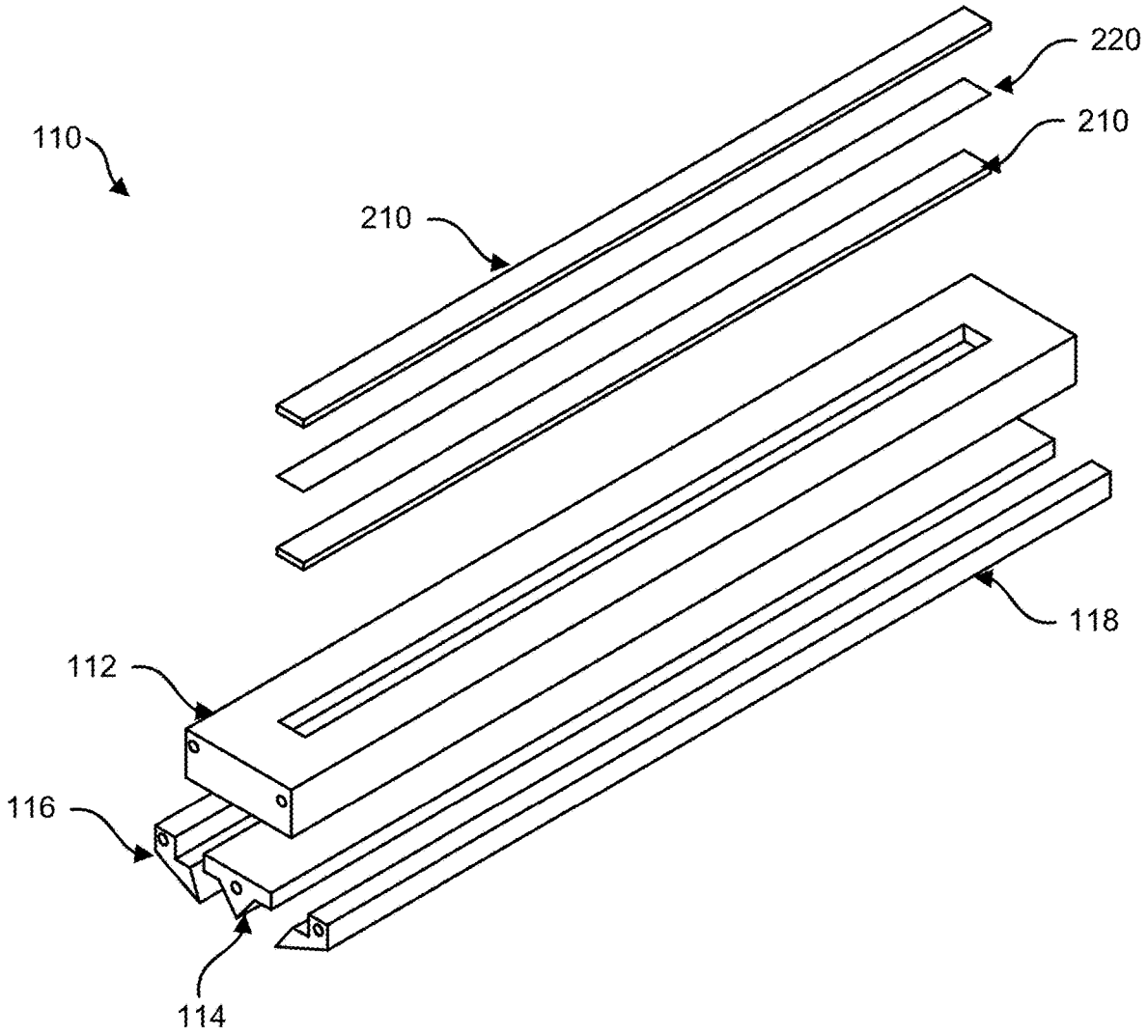
FIG. 2A is a perspective exploded view of a first embodiment of a replacement cartridge of the die tip assembly used in the meltblown system of FIG. 1.

FIG. 2A is a perspective exploded view of a first embodiment of a replacement cartridge of the die tip assembly 110 used in the meltblown system 100 of FIG. 1. FIG. 2A does not show the one or more end plates 130 as illustrated in FIG. 1. The replacement cartridge may or may not include the separate one or more end plates 130 because an equivalent end sealing structure may be integrated with either one of the die tip 114, the first air plate 116, the second air plate 118, and the mounting structure 112. In the first embodiment illustrated in FIG. 2A, the replacement cartridge may be used as a whole unit, such that a new and heated replacement unit can be provided standby to swap with the mounted and used unit. Utilizing the exchangeability, the replacement cartridge increases the operational efficiency. In some other embodiments, the interchangeable portion may or may not include the mounting structure 112. For example, as shown in the second embodiment in FIG. 2B, the replacement cartridge needs not include the mounting structure 112, for example, when the mounting structure 112 is integrated with the meltblown beam 120 or with the die tip 114.

In FIG. 2A, the exploded view illustrates the assembly relationship of the components. The die tip 114, the first air plate 116, and the second air plate 118 may be affixed together. For example, the die tip 114 may have a plurality of fastener holes on both sides for fastenably receiving the air plates 116 and 118, such as by screws, bolts, or jigs. In other embodiments, the air plates may be affixed onto the die tip 114 using other known or available fastening methods, such as welding, woodwork joints, adhesives, or other temporary or permanent means. The die tip 114, the air plates 116 and 118 may then be assembled with the mounting structure 112. For example, vertical fasteners can be used to hold the air plates 116 and 118 toward the mounting structure 112. In other instances, vertical or diagonal fasteners can be used to hold the die tip 114 to the mounting structure 112. To ensure the precision of the assembly, in some embodiments, the die tip 114 with the first and the second air plates 116 and 118 may be aligned to the mounting structure 112 using at least one dowel pin.

In the embodiment illustrated in FIG. 2A, breaker plates 210 may be used in the cartridge assembly for regulating and/or filtering the polymer flow before the polymer flow reaches the die tip 114. In some instances, one breaker plate 210 may be used together with a filter or a screen 220. In other instances, and as shown in FIG. 2A, two or more breaker plates 210 are used with one or more filter or screen 220 positioned in between the two or more breaker plates 210 for filtering away unwanted substances, such as articles greater than certain sizes.

Figure 2B:
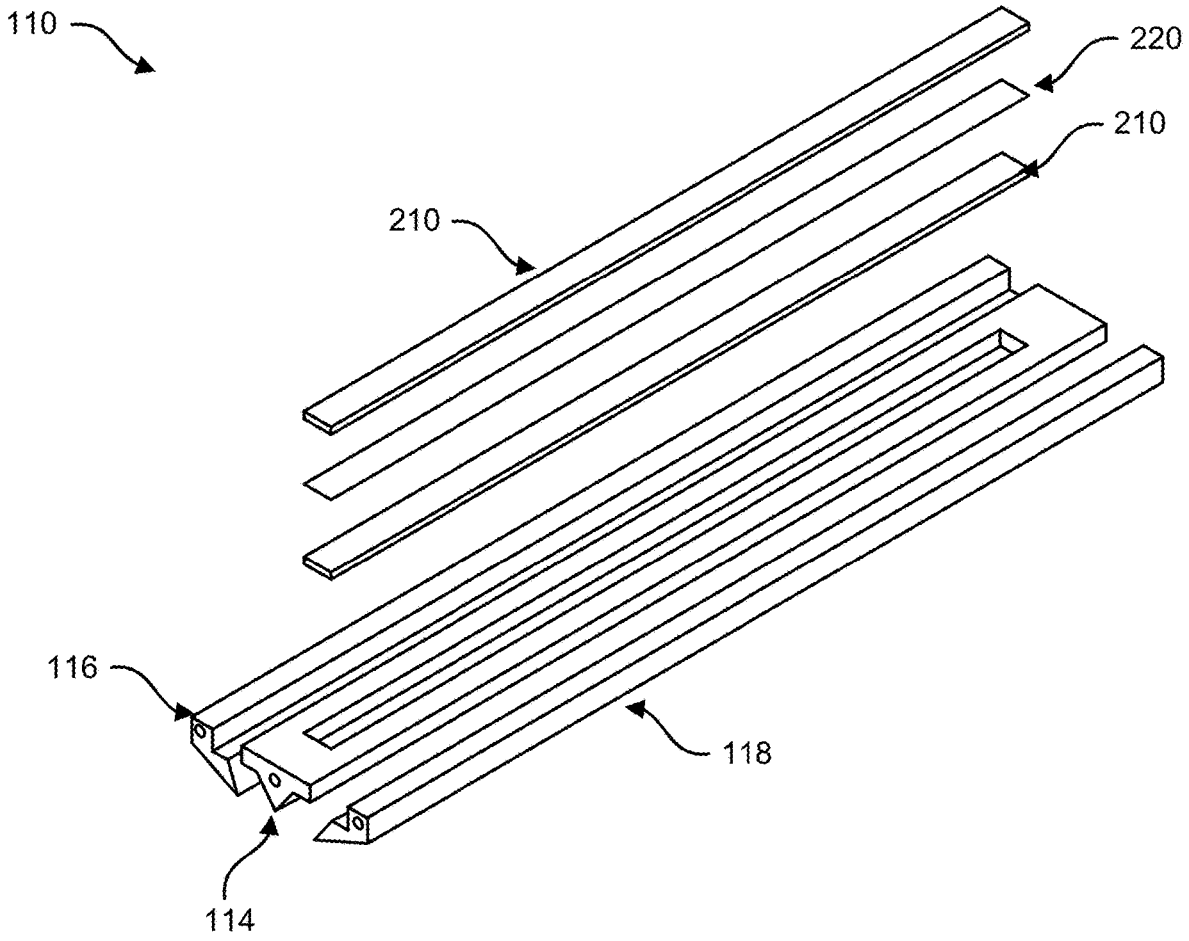
FIG. 2B is a perspective exploded view of another embodiment of a replacement cartridge of the die tip assembly used in the meltblown system of FIG. 1.

The breaker plates 210 and the filter 220 (if used) may be positioned anywhere along the polymer flow path, such as, for example, in an opening in the mounting structure 112 as shown in FIG. 2A or in an opening in the die tip 114 as shown in FIG. 2B. Although FIG. 2A shows the breaker plates 210 and the filter 220 are housed in an opening of the mounting structure 112 facing the meltblown beam 120, in other instances, the opening may be facing toward the die tip 114 (e.g., on the opposite side in the mounting structure 112). In yet some other embodiments, the opening receiving the breaker plates 210 and the filter 220 is located in the die tip 114 (as shown in FIG. 2B). In some other embodiments, the opening may be located inside the meltblown beam 120 above the mounting structure 112. Configurations may vary according to specific production demands.

FIG. 2B is a perspective exploded view of a second embodiment of the replacement cartridge of the die tip assembly 110 used in the meltblown system of FIG. 1. In this embodiment, the mounting structure 112 is not replaced or included in the replacement cartridge and the breaker plates 210 and filter 220 (if used) are installed inside the die tip 114. In the second embodiment, the mounting structure 112 may be part of the meltblown beam 120 or may not require replacement due to operation conditions. For example, in this embodiment, when the breaker plates 210 were clogged or having reduced flow efficiency, or when the die tip 114 required cleaning, only the die tip 114 and the first and the second air plates 116 and 118 are replaced, along, as needed, with the one or more breaker plate 210 and one or more filter or screen 220 if so applied.

Turning to FIGS. 3A through 3E, these figures show a front view of the die tip assembly 110 in different embodiments, showing the relationship of the components when they are assembled. Corresponding to FIGS. 3A through 3E, FIGS. 3F through 3J respectively present the cross sectional views. The cross sectional views provide a clear showing of the boundaries between two adjacent components. In some embodiments, the boundaries and holes or cavities thereof represented in the cross sections in FIGS. 3F-3J may or may not be within a same plane as shown. For example, the first air passageway 340 and the first air regulation channel 352 are shown to be in a same plane in the cross sectional views; but they can be located in different planes in other embodiments. In other embodiments, the features shown on the left side and the right side may be offset into or out of the plane (i.e., may not be symmetrical in a cross sectional view as shown). Although these five embodiments each has specific features, the illustrated features may be otherwise combined or altered as suggested by someone having ordinary skills in the art, using at least one or all of the presented features, depending on dimensional limitations, performance requirements, or cost concerns. These five embodiments share some common features that are discussed as follows.

The mounting structure 112 has a top mounting surface 310 and a bottom mounting surface 320. The mounting structure 112 includes at least one polymer flow passageway 330, receive a polymer flow from the meltblown beam 120. The mounting structure 112 includes a first air passageway 340 formed therein. As aforementioned, in certain embodiments, the mounting structure 112 may be integrated with either the meltblown beam 120 or the die tip 114. For example, the top mounting surface 310 and the bottom mounting surface 320 may be nonexistent in different embodiments. The top mounting surface 310 may not exist when the mounting structure 112 is integrated with the meltblown beam 120. Alternatively, the bottom mounting surface 320 may not exist when the mounting structure 112 is part of the die tip 114. Having the mounting structure 112 as a separate piece, as in the embodiments shown in FIGS. 3A-3J, can provide machining, maintenance, and assembly advantages.

The first air passageway 340 is configured to receive a first airflow from the meltblown beam 120. The mounting structure 112 further includes a second air passageway 342 formed therein. The second air passageway 342 receives a second airflow from the meltblown beam 120. In the embodiment illustrated, the first air passageway 340 and the second air passageway 342 are symmetrical about the polymer flow passageway 330. However, in other embodiments, the first and the second air passageways 340 and 342 may be placed at different locations, and/or may be offset in different planes.

The elongated die tip 114 is attached below the mounting structure 112 via, in certain implementations, at least partially through the first and the second air plates 116 and 118. The die tip 114 has a polymer flow chamber 350. The polymer flow chamber 350 receives polymer flow from the polymer flow passageway 330. The die tip 114 includes a body portion 360 and a polymer flow tip 372. The body portion 360 includes a first airflow regulation channel 352 and a second airflow regulation channel 354 disposed on opposing sides of the polymer flow chamber 350. The body portion 360 includes a first angled side 362 and a second angled side 364. The polymer flow tip 372 may be positioned a vertical distance away from an imaginary horizontal line between the tips of the first and the second air plates 116 and 118. This vertical distance is referred to as "setback," which in one implementation may be about 0.5 mm (about 0.02"), or about 0.25 to about 2.5 times of the tip-to-tip distance (about 1.27 mm) of the first and the second air plates 116 and 118. In certain embodiments, the setback may be about 0.5-1.8 times of the tip-to-tip distance of the first and the second air plates 116 and 118.

As shown in FIGS. 3A-3E, the polymer flow chamber 350 is in fluid communication with the at least one polymer flow passageway 330 of the mounting structure 112 at a first opening 358 of the polymer flow chamber 350. The polymer flow chamber 350 is configured to receive at least a portion of the polymer flow from the at least one polymer flow passageway 330 of the mounting structure 112. The polymer flow passageway 330 may include an increased width near the first opening 359 of the polymer flow chamber 350 such that cleaning tools can access internal surface of the at least one polymer flow passageway of the mounting structure 112. In other embodiments, the polymer flow passageway 330 may have different shapes or configurations that vary from the illustration shown in FIGS. 3A-3J. Two example variations for the polymer flow passageway 330 are provided in FIGS. 8A and 8B.

Figure 8A:
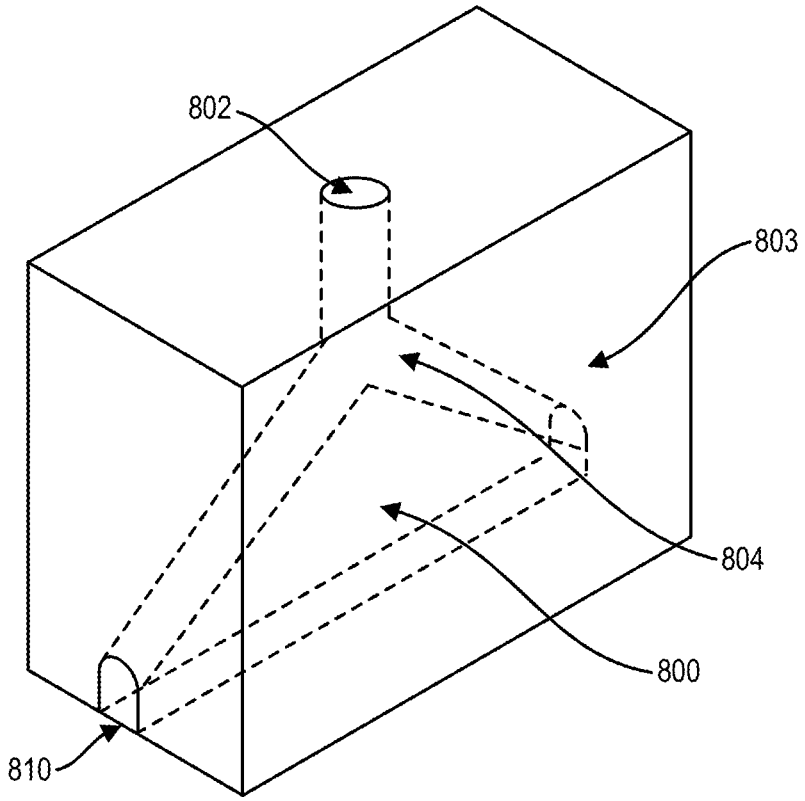
FIGS. 8A and 8B are perspective see-through views showing polymer flow passageway in an implementation of a mounting structure.
Figure 8B:
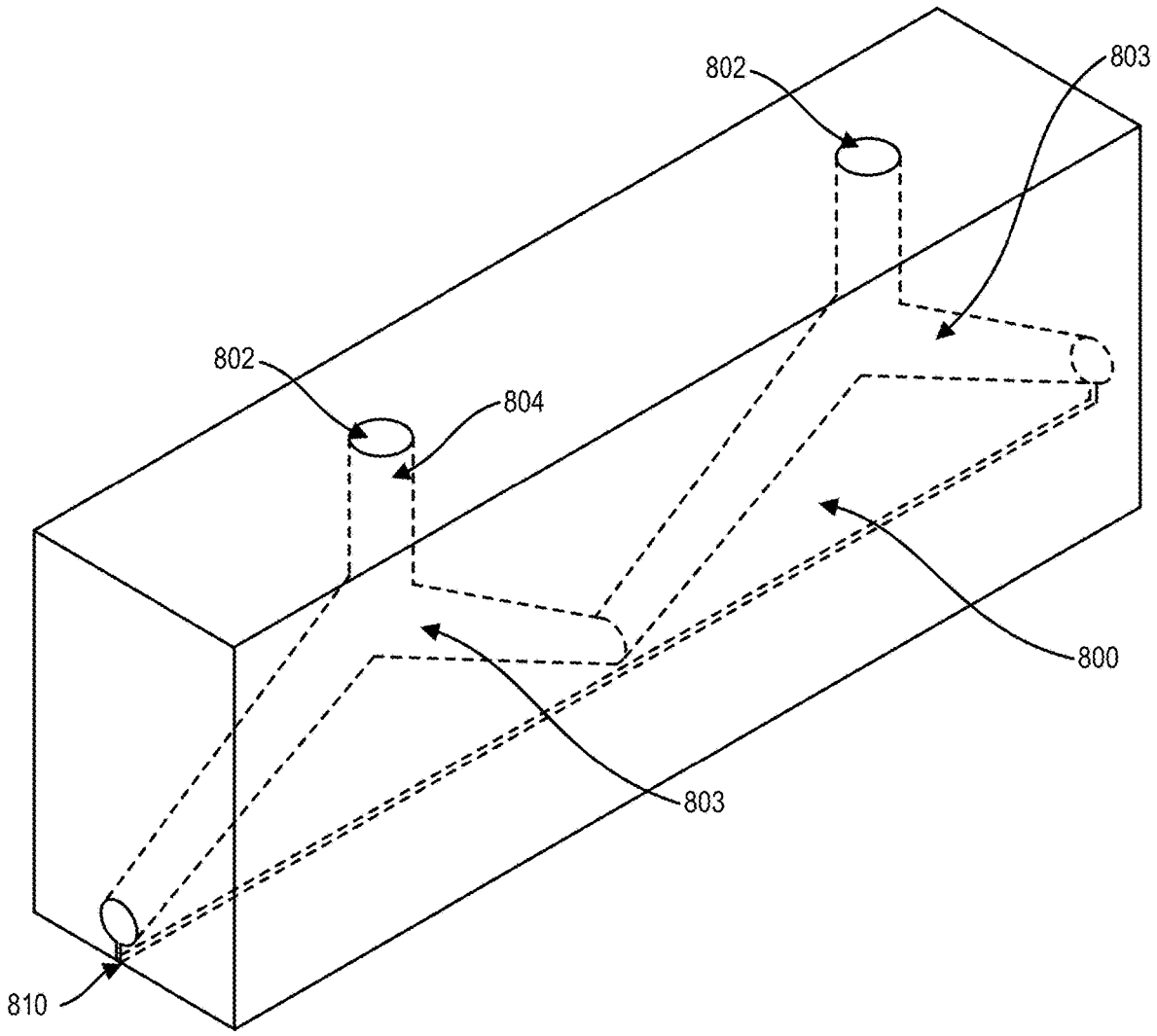

Temporarily turning to FIGS. 8A and 8B, examples of a polymer flow passageway 804 are illustrated to be used in the place of the polymer flow passageway 330. FIGS. 8A and 8B show perspective views of the polymer flow passageway 804 in an implementation in the mounting structure 112. The polymer flow passage way 804 generally includes a bottom opening 810 corresponding to the first opening 358, a tapered distribution portion 803, and a vertical distribution portion 800. However, specific configurations of the polymer flow passageway 804 can vary, as described below.

In FIG. 8A, the polymer flow passageway 804 includes an inlet 802, a tapered distribution portion 803, and a vertical distribution portion 800 connecting the bottom opening 810 to the tapered distribution portion 803. The internal surfaces of the at least one polymer flow passageway 804 may include a tapered top surface, such as the upper surface of the tapered distribution portion 803. The opening width of the vertical distribution portion 800 may vary depending on the intended flow rate. For example, FIG. 8A illustrates that the opening width of the vertical distribution portion 800 matches the width of the tapered distribution portion 803. In other embodiments, the opening width of the vertical distribution portion 800 may be narrower than the width of the tapered distribution portion 803, as shown in FIG. 8B. In FIG. 8B, two or more repeating inlets 802, tapered distribution portions 803 may be provided for an even distribution of the polymer flow a crossing a large width given certain height constraints. Although only two repetitions are shown in FIG. 8B, more repetitions may be added.

Returning to FIGS. 3A through 3J, the polymer flow passageway 330 is in fluid communication with the polymer flow chamber 350 at a first opening 359. The polymer flow chamber 350 is configured to receive at least a portion of the polymer flow from the polymer flow passageway 330 at the first opening 359, for example, via one or more breaker plates 202 (e.g., in FIGS. 2A and 2B). The polymer flow chamber 350 is in fluid communication with the polymer flow tip 372 at a second opening 384. The polymer flow chamber 350, the first opening 359, the second opening 384, and the polymer flow tip 372 are machined or otherwise hollowed from the body portion 360 of the elongated die tip 114. The polymer flow tip 372 receives at least a portion of the polymer flow from the polymer flow chamber 350 at the second opening 384 polymer flow chamber 350. The polymer flow tip 372 has a tip opening (see FIG. 5) configured to dispense at least a portion of the polymer flow.

The first airflow regulation channel 352 is configured to receive the first airflow from the first air passageway 340 of the mounting structure 112. The first airflow regulation channel 352 regulates the first airflow and dispense the first airflow adjacent the first angled side 362. Similarly, the second airflow regulation channel 354 is configured to receive the second airflow from the second air passageway 342 of the mounting structure 112. The second air flow regulation channel 354 assists in regulating the second airflow and dispenses the second airflow adjacent the second angled side 364.

The first airflow regulation channel 352 and the second airflow regulation channel 354 regulate the respective first and second airflows by providing a restricted flow cross section along a direction, such as a uniform direction, such that the first and second airflows exit the first and second airflow regulation channels 352 and 354 at a calculated or desired accelerated speed. The exit speed corresponds to a known initial system pressure, such as the pressure provided to the system at the source of air.

In some embodiments, the elongated die tip 114 includes an impingement portion 361 housing the first airflow regulation channel 352 and the second airflow regulation channel 354. The first air regulation channel 352 has a first impingement surface 353. The second airflow regulation channel has a second impingement surface 355. The first impingement surface 353 and the second impingement surface 355 regulate the first airflow and the second airflow respectively. For example, the first impingement surface 353 impinges or disrupts the first airflow in its initial traveling direction and forces the airflow to turn and reorganize. In addition, the impact between the first airflow and the first impingement surface 353 aids a transfer of energy from the first airflow to the impingement portion 361 and thus the die tip 114. For example, the first and the second airflows may enter the meltblown system at a high temperature for maintaining the liquidity state of the polymer flow. The impingement portion 361 and the first and the second impingement surfaces 353 and 355 provide a mechanism for efficient heat transfer and regulating the uniformity of the first and the second airflows.

The first air plate 116 is positioned at least partially adjacent the first angled side 362 of the elongated die tip 114. The first air plate 116 is configured to form a first air exit passageway 382. The first air exit passageway 382 is configured to receive the first airflow dispensed from the first airflow regulation channel 352 of the elongated die tip 114. The first air exit passageway dispenses the first airflow adjacent the tip opening 374 of the polymer flow tip 372. The at least a portion of the polymer flow is at least partially entrained with such first airflow due to the high speeds of the first airflow. In some embodiments, the first airflow may exit the tip opening 374 at about up to 0.8 times of the speed of sound in air. In other embodiments, this speed may be in a range that includes up to 0.8 times the speed of sound in air.

In the embodiments illustrated in FIGS. 3A-3J, the second air plate 118 is placed symmetrical to the first air plate 116 about the die tip 114. That is, the second air plate 118 is positioned at least partially adjacent the second angled side 364 of the die tip 114, which is elongated in certain implementations. The second air plate 118 is configured to form a second air exit passageway 383 that is configured to receive the second airflow dispensed from the second airflow regulation channel 354 of the elongated die tip 114. The second air exit passageway 383 dispenses the second airflow adjacent the tip opening 374 of the polymer flow tip 372 and the at least a portion of the polymer flow to at least partially entrain such second airflow with the polymer flow.

In the embodiments shown in FIGS. 3A-3J, and specifically in the embodiments shown in FIGS. 3D, 3E, 3I, and 3J, the body portion 360 includes an impingement portion 361 housing the first airflow regulation channel 352 and the second airflow regulation channel 354. The impingement portion 361 provides a base for making the plurality of threaded holes 205 that may be used for assembly with the first and the second air plates 116 and 118. In some embodiments, when the first and the second air plates 116 and 118 are assembled with the die tip 114 using fasteners engaging the plurality of threaded holes 205, the impingement portion 361 is sealingly coupled with the first and the second air plates 116 and 118 such that the airflow exiting the first and the second air flow passageways 340 and 342 of the mounting structure 112 are directed to enter the first and the second airflow regulation channels 352 and 354.

Figure 3A:
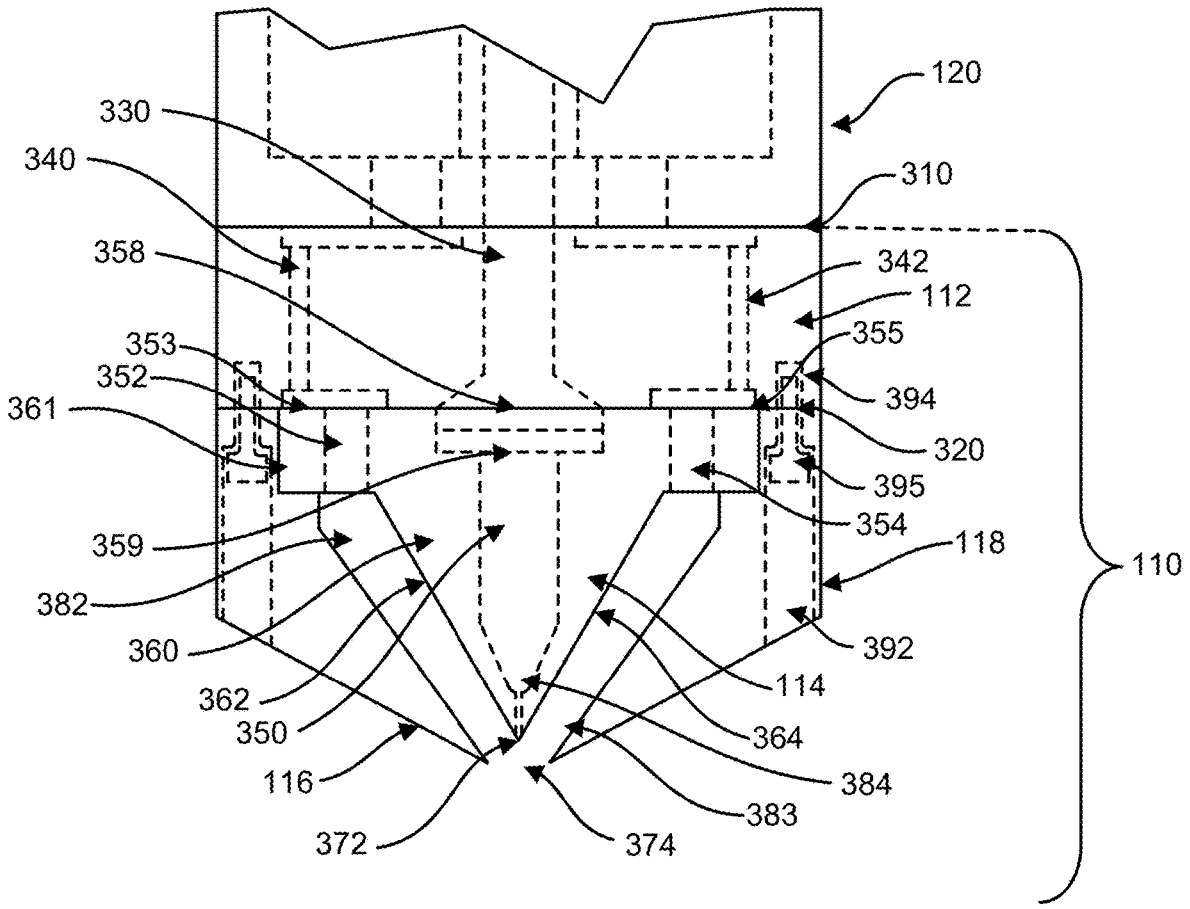
FIGS. 3A-3E are front views of different embodiments of the replacement cartridge of FIG. 2B.
Figure 3B:
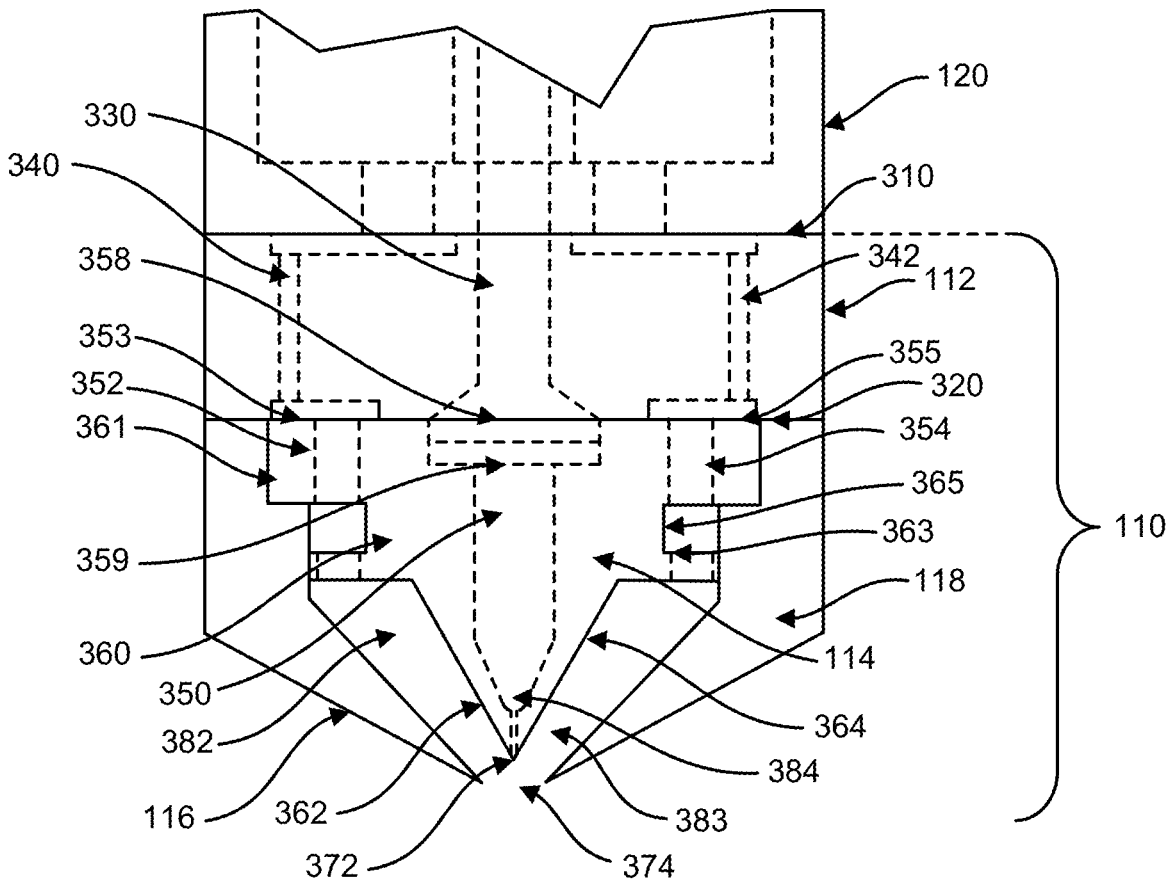
Figure 3C:
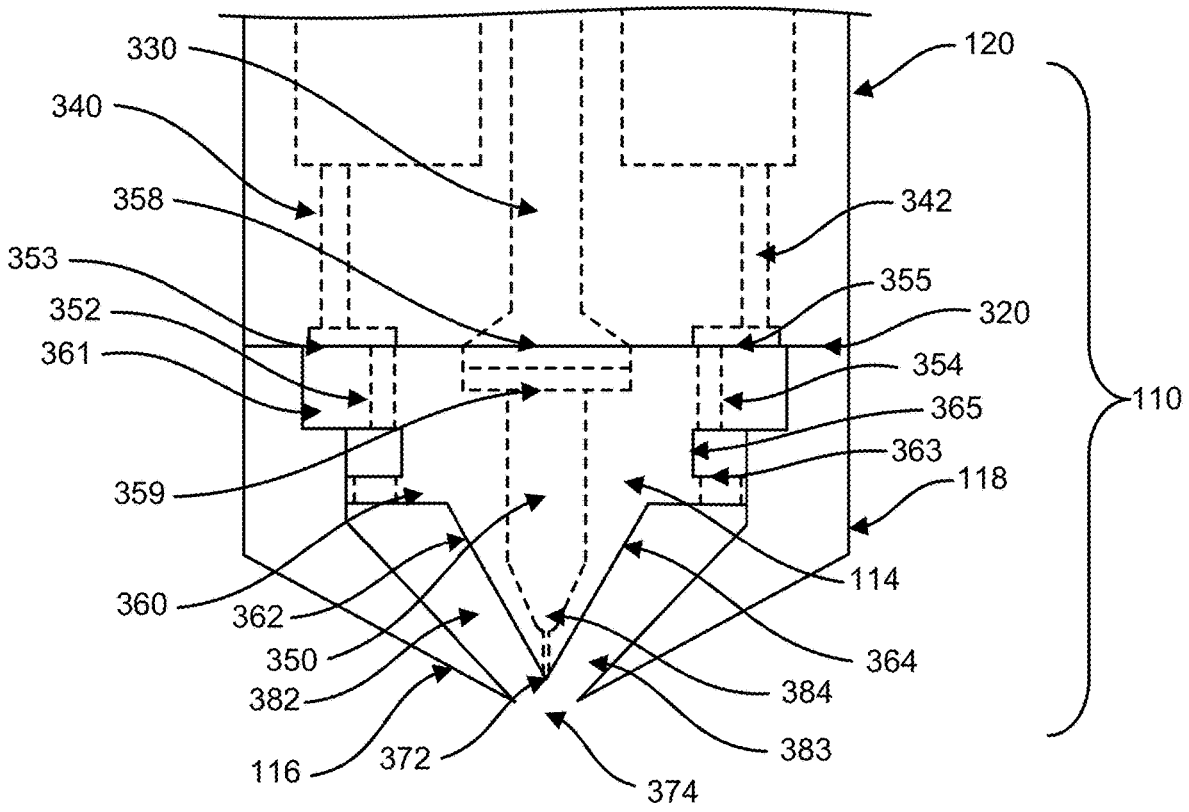
Figure 3D:
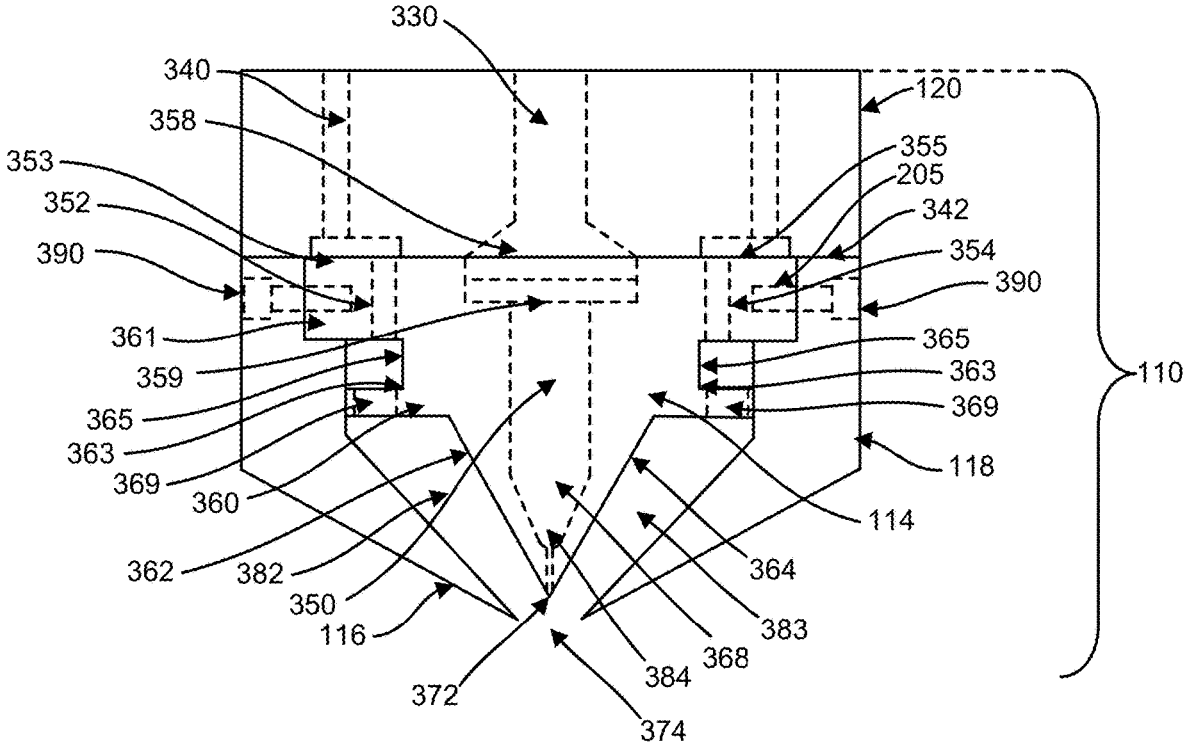
Figure 3E:
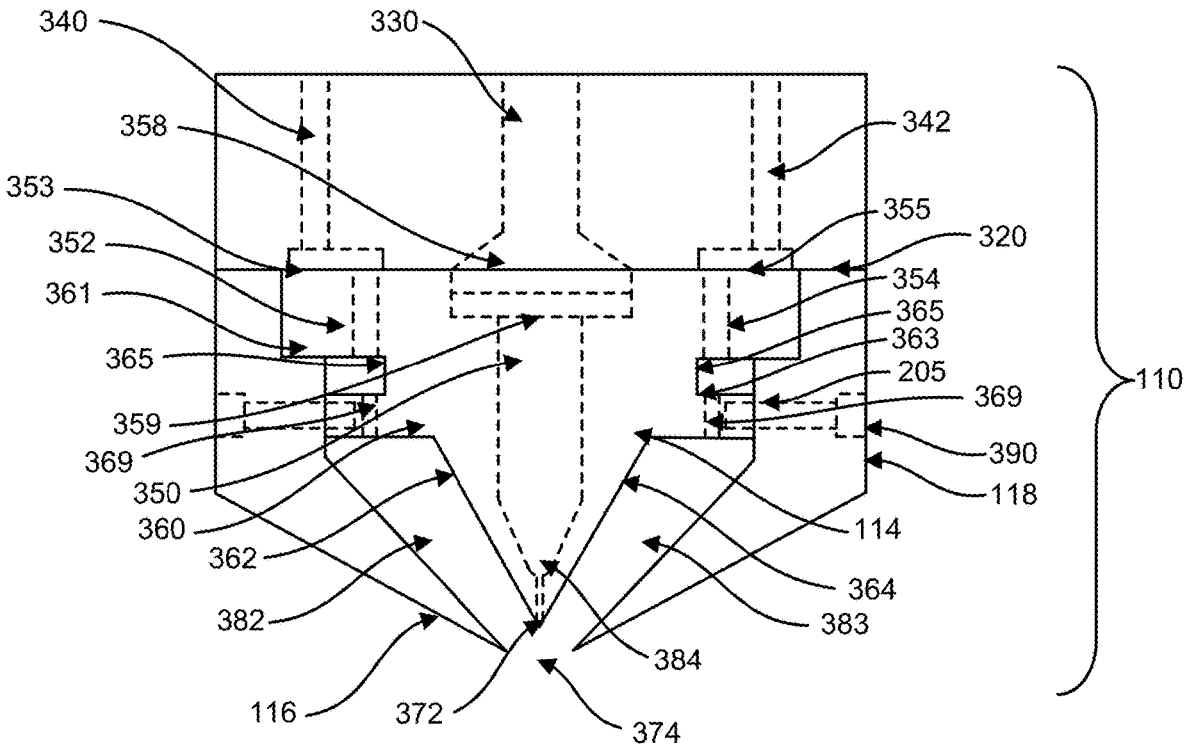
Figure 3F:
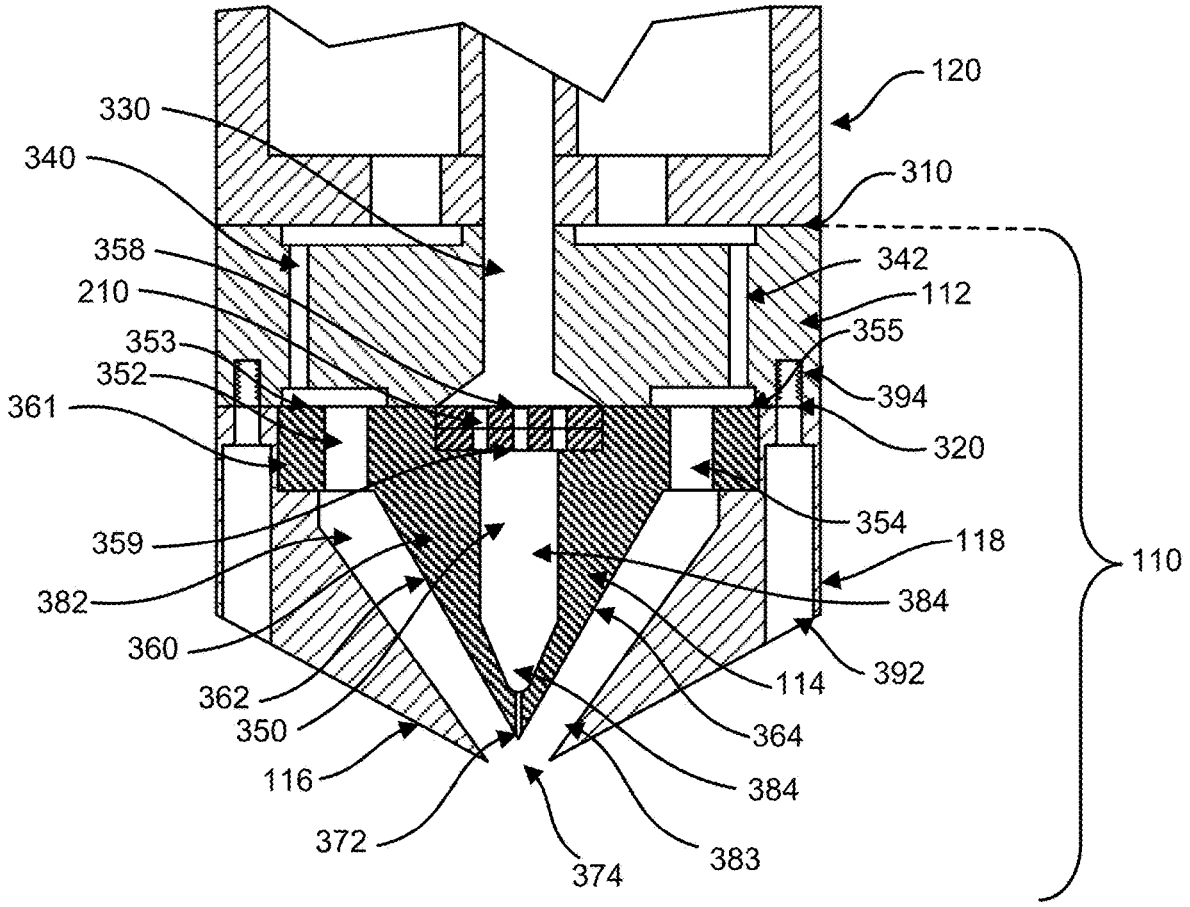
FIGS. 3F-3J are cross sectional views of different embodiments of the replacement cartridge respectively corresponding to the examples shown in FIGS. 3A-3E.
Figure 3G:
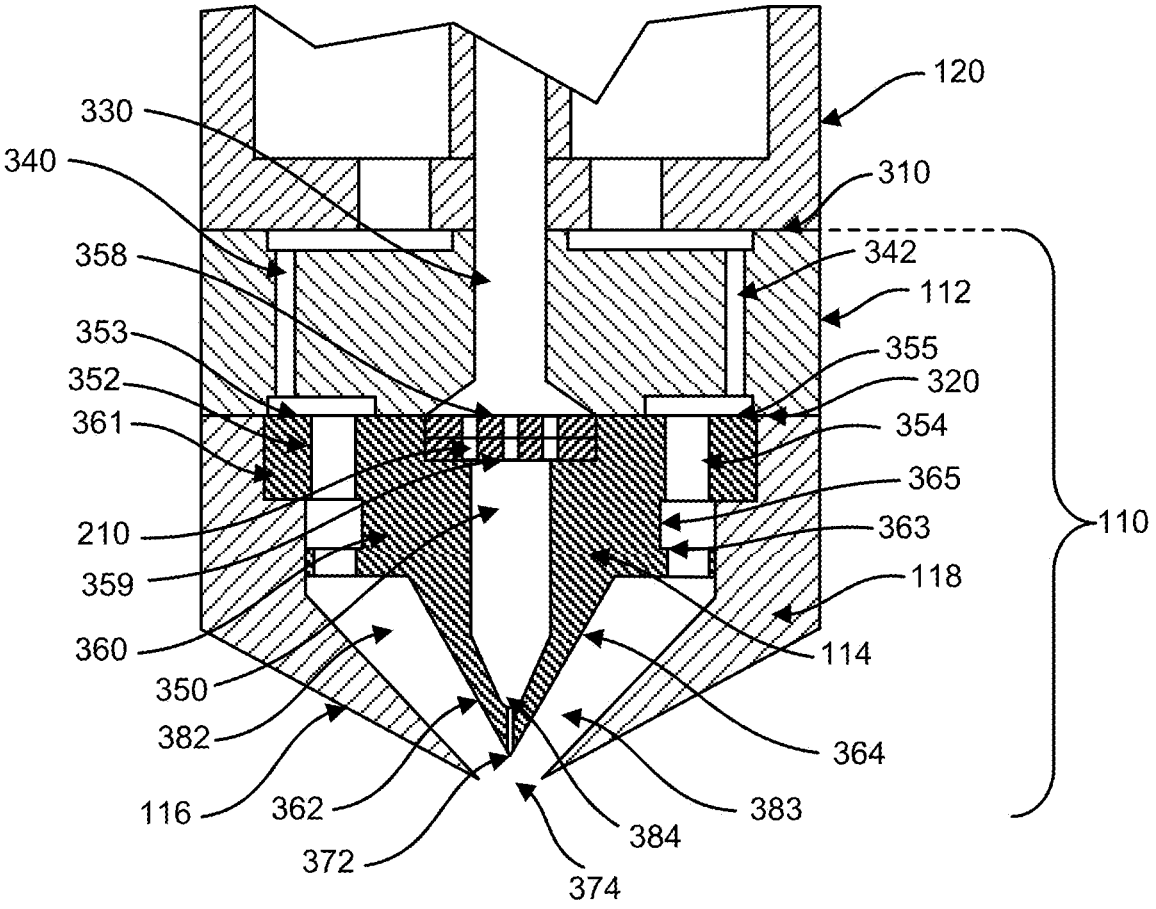
Figure 3H:
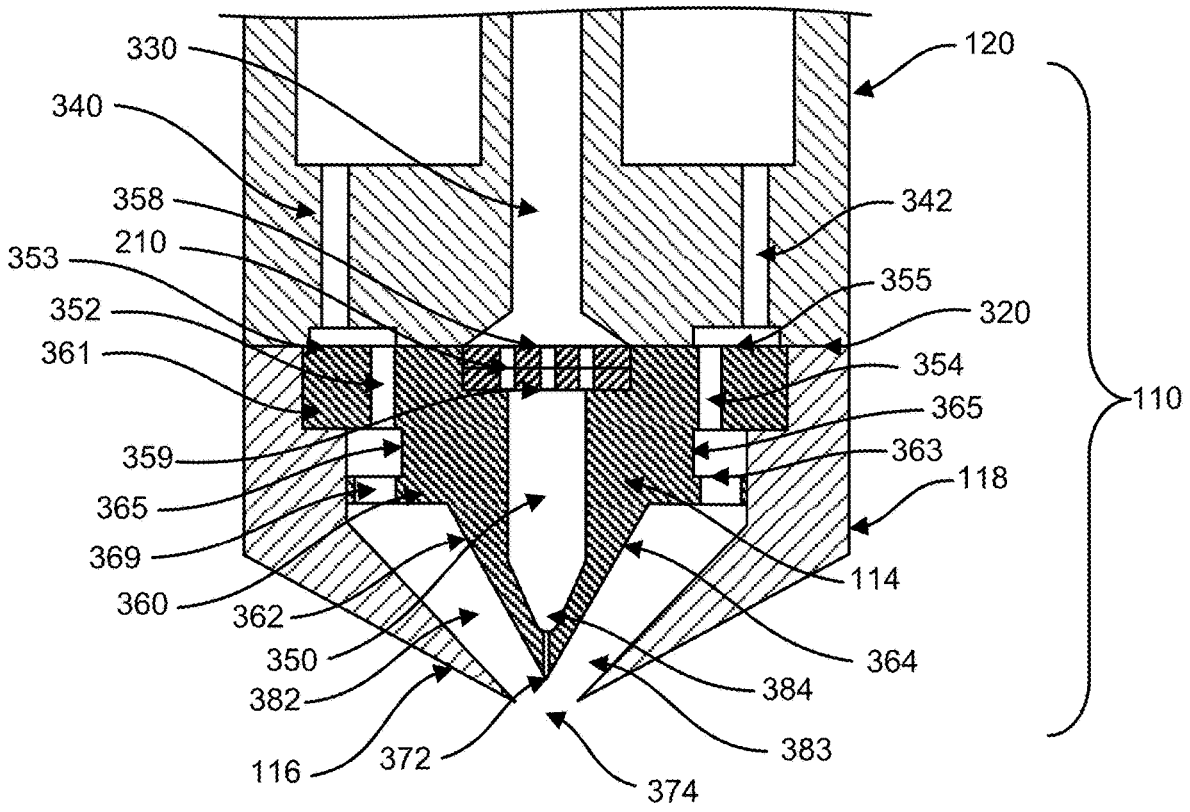

In some embodiments, such as in FIGS. 3A and 3F, the air plates 116 and 118 may be directly fastened to the mounting structure 112 using fasteners 395 through holes 392 at the receiving holes 394. In some embodiments, the elongated die tip 114 is not directly fastened onto the mounting structure 112 but relies on the air plates 116 and 118 for sealingly attach to the mounting structure 112. In some embodiments, the fastener arrangements of FIGS. 3A, 3D, and/or 3E may be combined with modification to make use of both or all features contained therein.

In one embodiment, the first airflow passageway 340 of the mounting structure 112 is not aligned with the first airflow regulation channel 352 such that the impingement portion 361 of the body portion 360 can decelerate and re-organize or reassemble the airflow before it is fed into the first airflow regulation channel 352. Such regulation effect resets the airflow dynamics so that the airflow dynamics in the first airflow regulation channel 352 is at least partially independent from the airflow dynamic of the first airflow passageway 340.

Similarly, the second airflow passageway 342 of the mounting structure 112 is not fully aligned with the second airflow regulation channel 354 such that the impingement portion 361 of the body portion 360 can decelerate and re-organize the airflow before it is fed into the second airflow regulation channel 354. This arrangement resets the airflow dynamics so that the airflow dynamics in the second airflow regulation channel 354 is different from the airflow dynamic of the second airflow passageway 342.

In addition, the body portion 360 of the die tip 114 includes a neck portion 365 that is narrower than the impingement portion 361. The neck portion 365 obstructs airflows exiting the first airflow regulation channel 352 and the second airflow regulation channel 354 using a transition surface 363 (e.g., a second impingement surface) extending from either side of the neck portion 365 to the first or the second angled side 362 and 364. As such, the neck portion 365 reduces a width of the body portion 360 such that a transition surface 363 extending from the neck portion 365 to the first angled side 362 impedes the first airflow exiting the first airflow regulation channel 352. The transition surface 363 thus can function as a second level impingement surface and regulates and reassemble the first or second airflow in similar manners as the impingement surfaces 353 and 355. The first angled side 362 is adjacent to a first air plate 116 for directing and accelerating the first airflow impeded by the transition surface 363.

The first airflow regulation channel 352 is configured to receive the first airflow from the first air passageway 340 of the mounting structure 112. The first airflow regulation channel 352 and the neck portion 365 regulate the first airflow and dispense the first airflow adjacent the first angled side 362 after deceleration and acceleration around the neck portion 361 and the transition surface 363, as described above. For example, in the embodiments illustrated in FIGS. 3B-3E, and 3G-3J, the neck portion 365 and the transition surface 363 provides another impingement location and mechanism for efficient heat transfer and disrupting the flowing-by airflows for improving subsequent flow uniformity.

The second airflow regulation channel 354 is also configured to receive the second airflow from the second air passageway 342 of the mounting structure 112. The second airflow regulation channel 354 and the neck portion 365 regulate the second airflow and dispense the second airflow adjacent the second angled side after deceleration and acceleration around the neck portion 361. The neck portion 365 effectively avoids, removes, or reduces formation of eddy flow in later development around the first and the second angled sides 362 and 364, thus achieving a more uniform and higher speed airflow. Both the neck portion 365 and the impingement portion 361 enable the body portion 360 to avoid, in certain implementations, from having any fastener interfering with the first or the second airflow from the first and second airflow passageways 340 and 342 to the tip opening 374.

Turning to specific features of each embodiment, FIG. 3A (3F) illustrates an embodiment that does not include the neck portion 365 as illustrated in FIGS. 3B (3G), 3D (3I), and 3E (3J). In other embodiments, however, FIG. 3A may also include a structure similar to the neck portion 365 as shown in FIG. 3B (3G), for example, having a narrowed portion regulating airflows either in the die tip 114 or in the mounting structure 112. FIG. 3C (3H) illustrates an embodiment where the mounting structure 112 is integral with the meltblown beam 120 and thus not a separate component of the meltblown system 100 as illustrated.

FIGS. 3D (3I) and 3E (3J) illustrate the replacement cartridge 110 that may include the mounting structure 112 and the die tip 114, as well as the first and the second air plates 116 and 118. In other embodiments, however, the mounting structure 112 and the die tip 114 may be manufactured as the same piece. The first and the second air plates 116 and 118 are then assembled onto the die tip 114. In other embodiments, however, FIGS. 3D (3I) and 3E (3J) differs in that the connection location (e.g., where fasteners are provided) between the air plates 116 and 118 and the die tip 114 may be at different locations, as the threaded holes 205 are provided at different locations. Other implementations are possible, such as combining or mixing two or more features presented in FIGS. 3A through 3J.

Figure 3I:
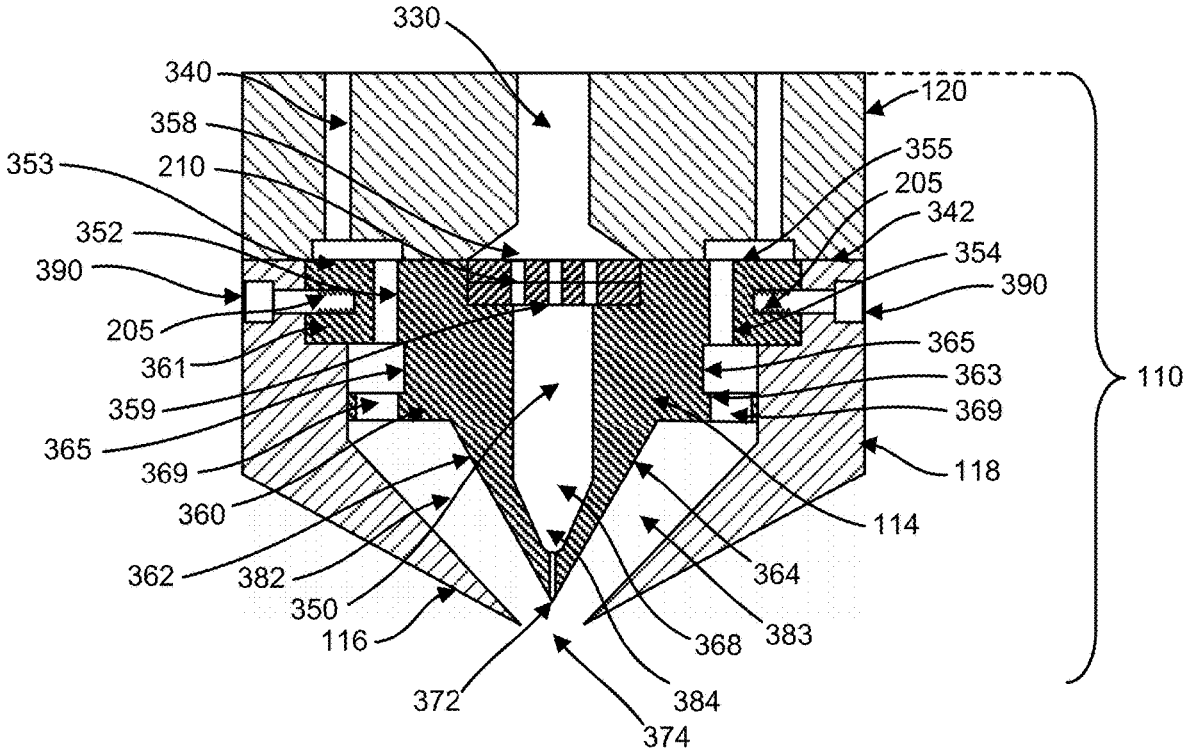
Figure 3J:
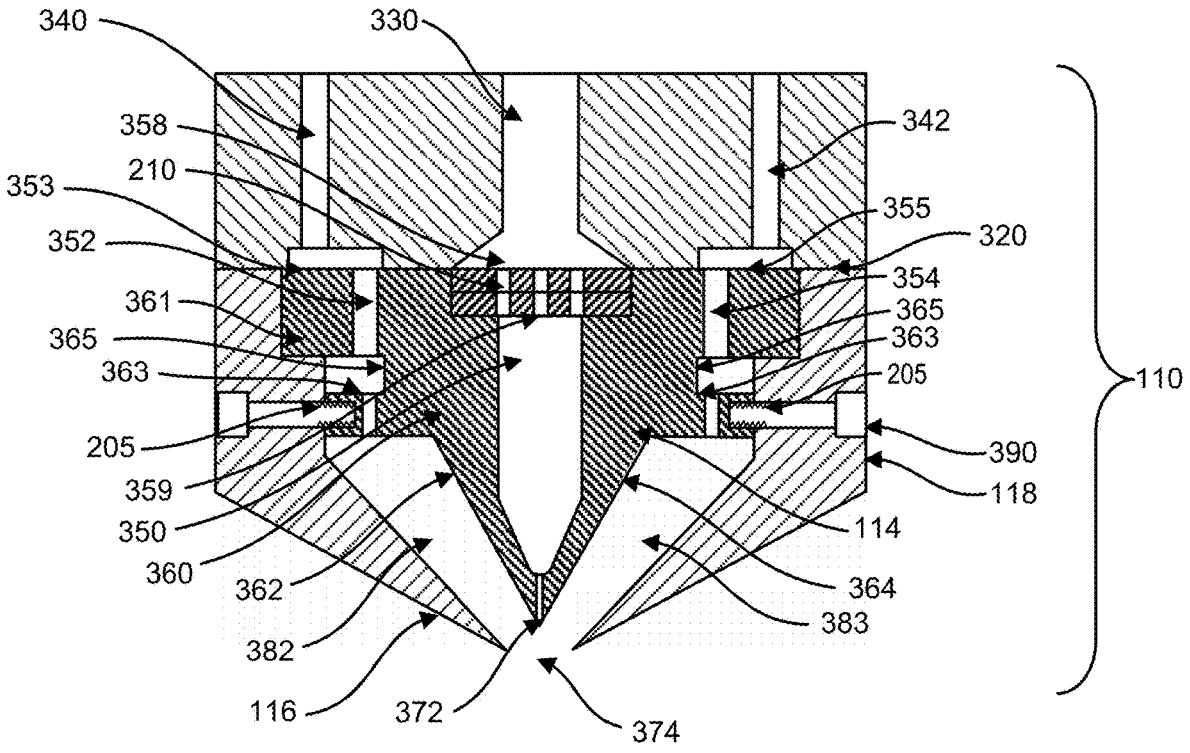

In the embodiment shown in FIGS. 3E and 3J, the first air plate 116 and the second air plate 118 are mounted onto the mounting structure 112 using a plurality of fasteners 390 perpendicular to the vertical direction of the polymer flow chamber 330, at the threaded holes 205. Although the fasteners 390 are illustrated in such specific orientation, in other implementations, the fasteners 390 may be vertical or diagonal depending on access constraints. Yet still, the first airflow and the second airflow are not impeded by or in contact with any fastener or other undesired obstructions when the first airflow travels from the first airflow regulation channel 352 to reach the polymer flow die tip 372, and the second airflow travels from the second airflow regulation channel 354 to reach the polymer flow die tip 372. In some embodiments, the elongated die tip has an overall width into the page between about 0.5-1.0 meter to about 5.5 meters. For example, the polymer flow tip 372 can be repeated at about 25 to 100 polymer flow tips per inch (or about 1-4 polymer flow tips per mm) along the overall width. The polymer flow tip 372 has a diameter of about 0.05 mm to about 1.00 mm.

In operation, the first airflow and the second airflow may be accelerated, for example, to up to about 0.7 to about 0.8 Mach speed and heated to about 100 to about 375 degrees Celsius for fiberizing polymer fluids at the tip opening of the elongated die tip. The second airflow is accelerated to a substantially same level of speeds as the first airflow when reached at the polymer flow tip 372 such that both the first airflow and the second airflow are entrained to draw and blow out the polymer from the polymer flow tip 372. In some embodiments, the first airflow and the second airflow are entrained at a sharp or desired angle of about 50 degrees. In other embodiments, the first airflow and the second airflow are entrained at an angle greater than 50 degrees and less than 90 degrees. Correspondingly, the outer surfaces of the first and the second air plates 116 and 118 can form an angle of about 100 degrees to about 160 degrees.

Figure 10:
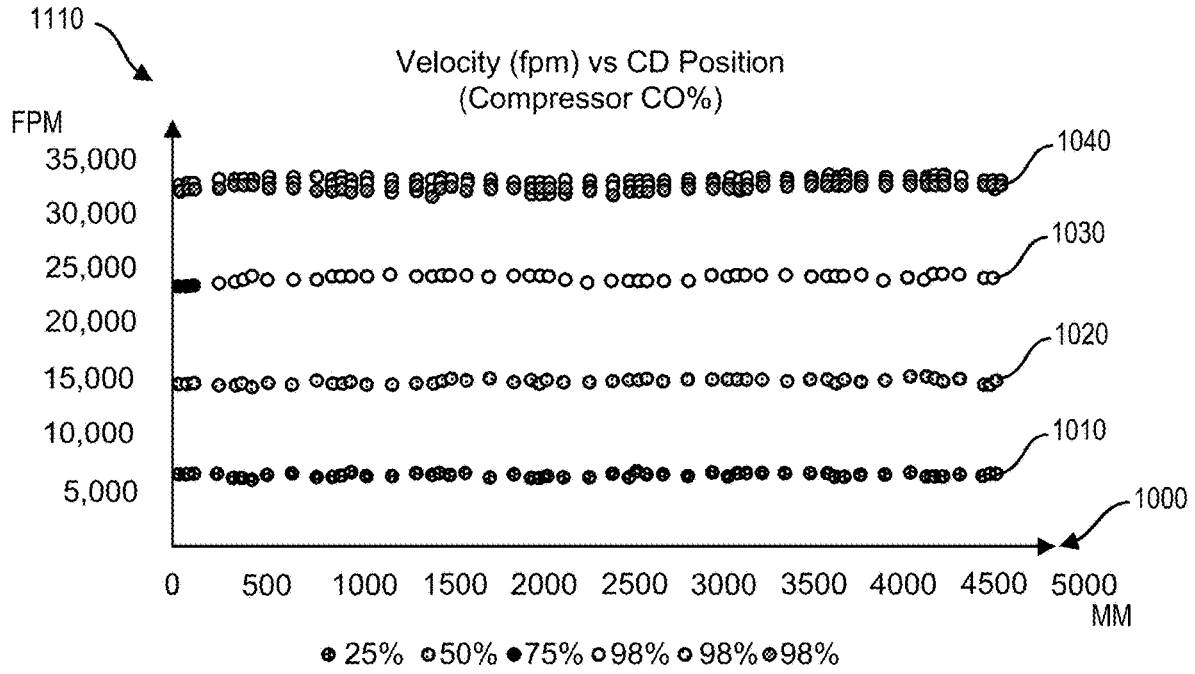
FIG. 10 is a plot of measurements of airflow uniformity produced by an example replacement cartridge incorporating features of the examples of FIGS. 3A-3J.

The embodiments illustrated in FIGS. 3A through 3J can produce entrained airflows of the first airflow and the second airflow at very high uniformity. Turning temporarily to FIG. 10, which shows measurements of air uniformity across the width of the die tip assembly 110. The horizontal axis 1000 shows the width location (in millimeters as measured starting from one end) of the die tip assembly 110. The vertical axis 1100 represents the output velocity measured at about 12 mm (or 0.5") below the airflow entrainment point (e.g., entrainment point 430 of FIG. 4A), measured in feet per minute (FPM). The grouped measurements 1010, 1020, 1030, and 1040 respectively represent the output percentage 25%, 50%, 75%, and 98% of the air compressor or air output. Three sets of measurements 1040 are provided for the output at 98% to account for measurement variations or errors. As the measurement shows, the output velocity are consistent across the width of the die tip assembly 110. Slightly reduced output velocity may be observed at the two ends of the die tip assembly 110 when the compressor output is at 98%, yet the variations are still within 2.5% of the average output velocity. Such uniform performance will in turn improve the uniformity of the drawn polymer flow and its fiberization.

Figure 3K:
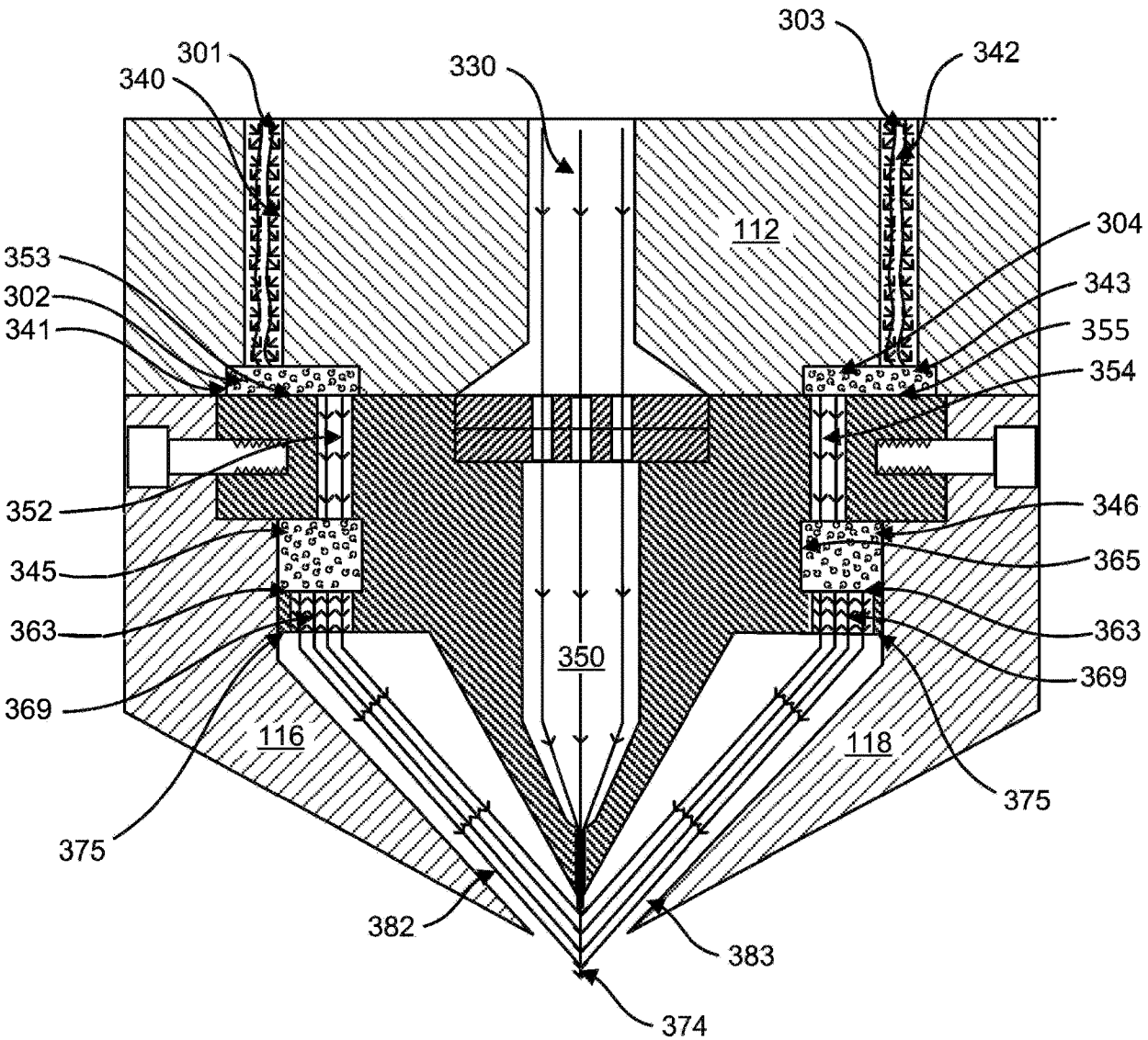
FIG. 3K is a detailed cross sectional view showing the airflows in the embodiment of the replacement cartridge of FIG. 3I.

Turning now to FIG. 3K, the detailed cross sectional view illustrates the first airflow 301 and the second airflow 303 in the embodiment of the replacement cartridge shown in FIG. 3I. Other embodiments of FIGS. 3F, 3G, 3H, and 3J share similar illustrated flow patterns as does that of FIG. 3K. When the first airflow 301 enters the first air passageway 340, the first airflow 301 is not uniform and may exhibit different velocities and/or different pressures in the first air passageway 340. A method of improving the uniformity of the airflows 301 and 303 is discussed here. As the pressurized air is fed into one or more air passageways (e.g., 340 and 342) in the mounting structure 112, the air travels at a high velocity. The moving air is impinged by the impingement surface 353 near the exit of the first air passageway 340. The obstruction provided by the impingement surface 353 forces the first airflow 301 to redistribute and reassemble within a first plenum 341 above the impingement surface 353. In the first plenum 341, the airflow 301 becomes a redistributed or reassembled airflow 302. Although the first plenum 341 is illustrated to be within the mounting structure 112, the first plenum 341 may be extended into spaces occupied by the die tip 114 in other embodiments.

The reassembled first airflow 302 the travels into the air regulation channel 352 of the die tip 114 and enters a second volume or plenum 345 created between the neck portion 365 and the first air plate 116. Similarly, the second airflow 303 enters the second air passageway 342 and is reassembled in a first plenum 343 to become a reassembled airflow 304, which enters the second air regulation channel 354 and then reassembled again in a second plenum 346 created between the neck portion 365 and the second airplate 118. The second plenums 345 and 346 have a lower bound provided by the transition (second impingement) surface 363, which further disrupts and causing the airflows 301 and 303 to reassemble once more. As such, the uniformity of the airflows 301 and 303 is improved. The airflows 301 and 303 then enters and passes through a set of exit holes 369 and enters the air exit passage ways 382 and 383 respectively. The airflows 301 and 303 are accelerated in the air exit passage ways 382 and 383 to draw the polymer provided in the polymer flow tip 372 for melt blowing.

In some embodiments, the exit holes 369 below the transition surfaces 363 may be replaced with an equivalent structure, such as a gap (not illustrated) between the wide portion 375 that is under the neck portion 365 and either of the air plates 116 and 118. The gap may have a consistent width along the width (in the cross direction) of the die tip 114. Such configuration may avoid minor machining inconsistencies of the multiple exit holes 369 along the width of the die tip 114.

Figure 4A:
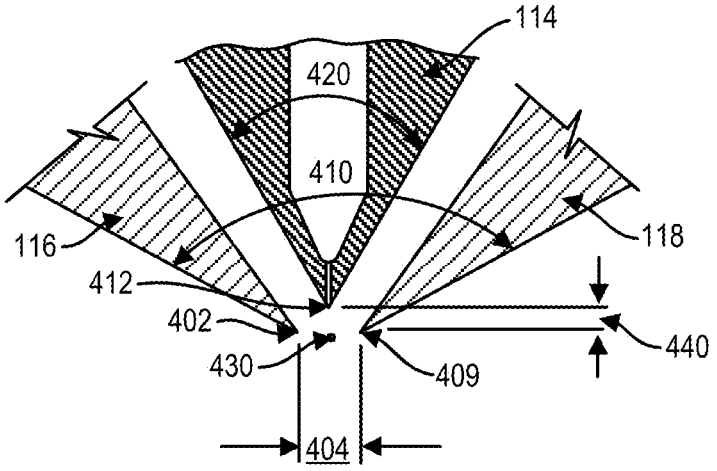
FIGS. 4A-4D are local cross sectional views of specific features of an embodiment of the die tip.

FIGS. 4A-4D are local cross sectional views of specific features of an embodiment of the die tip 114. Referring first to FIG. 4A, geometric relationships between the die tip 114 and the first and the second air plates 116 and 118 are illustrated. The first and the second air plates 116 and 118 form a pointy angle 410 between their respective outer surfaces. The die tip 114 has a pointy or external angle 420. In some embodiments, the pointy angle 410 ranges between 90 degrees and 140 degrees. In other embodiments, the pointy angle 420 ranges between 50 degrees and 90 degrees. The elongated die tip 114 includes an angled tip 412, such as the polymer flow tip 372 of FIG. 3A. The first air plate 116 includes a first tip 402.

The second air plate 118 includes a second tip 409. The distance between the first tip 402 and the second tip 409 is defined as the tip-to-tip distance 404. The vertical distance between the angled tip 412 and both the first and the second tips 402 and 409 is defined as a set-back dimension 440. In some embodiments, the setback dimension 440 is between about 0.5 mm and 4.0 mm. In some embodiments, the ratio between the setback dimension 440 and the tip-to-tip distance 404 is a design parameter for achieving good melt-blown performance. For example, the ratio of the setback dimension and the tip-to-tip distance is about 0.25 to 2.5.

FIG. 4A further shows an illustrative entrainment point 430. The entrainment point 430 represents a location for the first airflow and the second airflow meet at high speeds and create a low pressure point, drawing out the polymer flow from the elongated die tip 114 as well as drawing in surrounding air. The entrainment point 430 may be considered as a tip apex for the first airflow and the second flow to be entrained such that no interfering structure is presented with, in one embodiment, at least about 38 mm away from the tip apex. For example, the distance between the entrainment point 430 and the exit opening of the first or the second air regulation channels 340 and 342 is no less than 38 mm in certain implementations, and that the outside space of the first and the second air plates 116 and 118 does not include any obstruction. Such configuration improves the die tip 114's ability in improving fiber size in the polymer flow output as well as improves the uniformity of the entrained airflow.

Figure 4B:
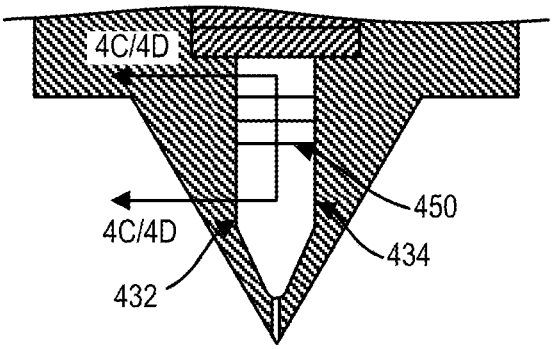
Figure 4C:
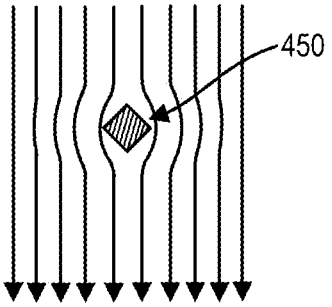
Figure 4D:
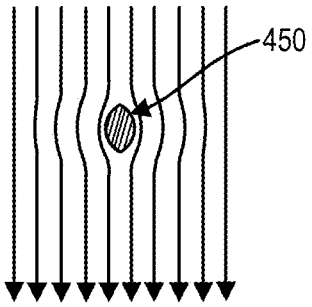

FIGS. 4B-4D shows embodiments of a rib structure 450 supporting the inner cavity of the die tip 114. The polymer flow chamber 364 of the elongated die tip 114 has a first side wall 432 and a second side wall 434 opposing the first side wall 432. The rib 450 connects the first side wall 432 to the second side wall 434. The rib 450 has a cross sectional fluid dynamic shape to promote laminar flow in the polymer flow, in the polymer flow chamber 364 of the elongated die tip 114. FIGS. 4C and 4D provides two different embodiments of the rib 450.

Figure 5:
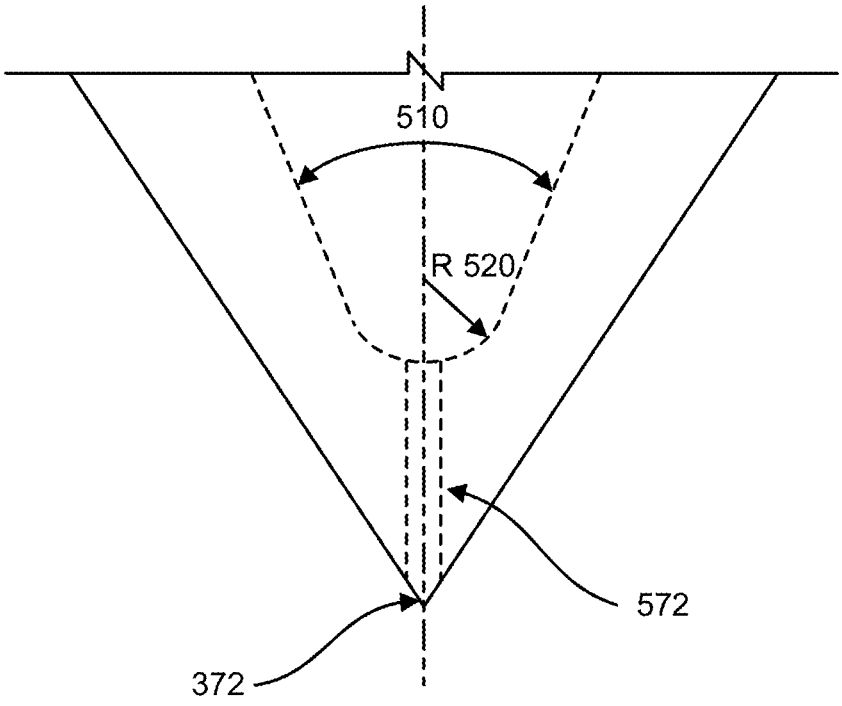
FIG. 5 is a local front view of an embodiment of the polymer flow tip of the die tip.

FIG. 5 is a local cross-sectional front view of an embodiment of the polymer flow tip 372 of the die tip 114 of FIGS. 3 and 4. In the illustrated embodiment, the polymer flow tip 372 has an internal angle 510 of about thirty degrees in one embodiment. The tip opening 572 has a diameter, in one embodiment, of about 0.3 millimeters, but such may vary as desired. The polymer flow tip 372 includes a transitional radius 520 for defining a rounded transition near the tip opening 572. In the illustrated embodiment, the transitional radius 520 is about 1.2 mm. In other implementations, the transitional radius 520 may be provided from about 0.5 mm to about 2.5 mm. In some embodiments, the internal angle 510 may change according to variation of the pointiness of the polymer flow tip 372. For example, when the polymer flow tip 372 has a greater angle, the internal angle 510 may be greater accordingly.

Figure 6:
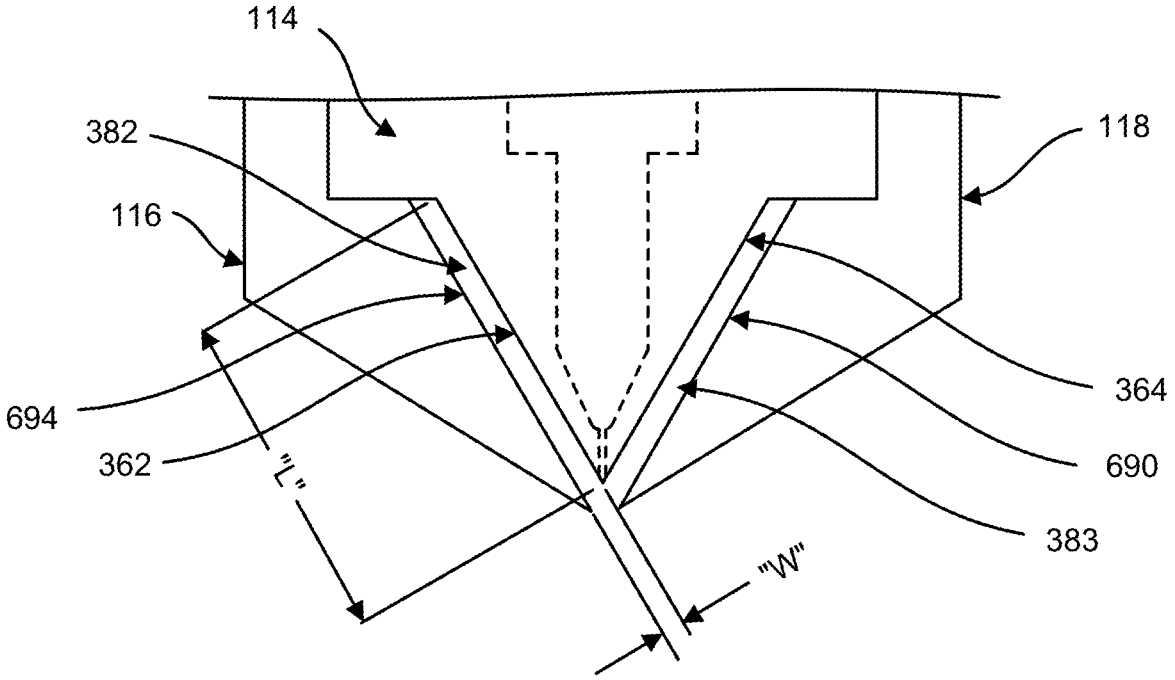
FIG. 6 is another local front view of an embodiment of the polymer flow tip of the die tip.

FIG. 6 is another local front view of an embodiment of the polymer flow tip of the die tip 114. In this view, it shows that the inner surface 694 of the first air plate 116 and the inner surface 690 of the second air plate 118 are planar and approximately parallel to the angled surfaces 362 and 364 of the elongated die tip 114. In other implementations, such surfaces may not be parallel. The inner surfaces 694 and 690 are respectively distanced away from the angled surfaces 362 and 364 by a width "W." There is a clearance distance "L" from the polymer flow tip 372 of the die tip 114 to the base of the die tip 114. In some embodiments, the clearance distance is at least 38 mm long and no other obstacles will intrude the space within that length. In some embodiments, the ratio between W and L may be set at a desired range, such as about 10 to about 40. In other embodiments, The width W may vary along the length of L, such as, for example, according to certain profile for accelerating the speeds of the first and the second airflows.

Figure 7:
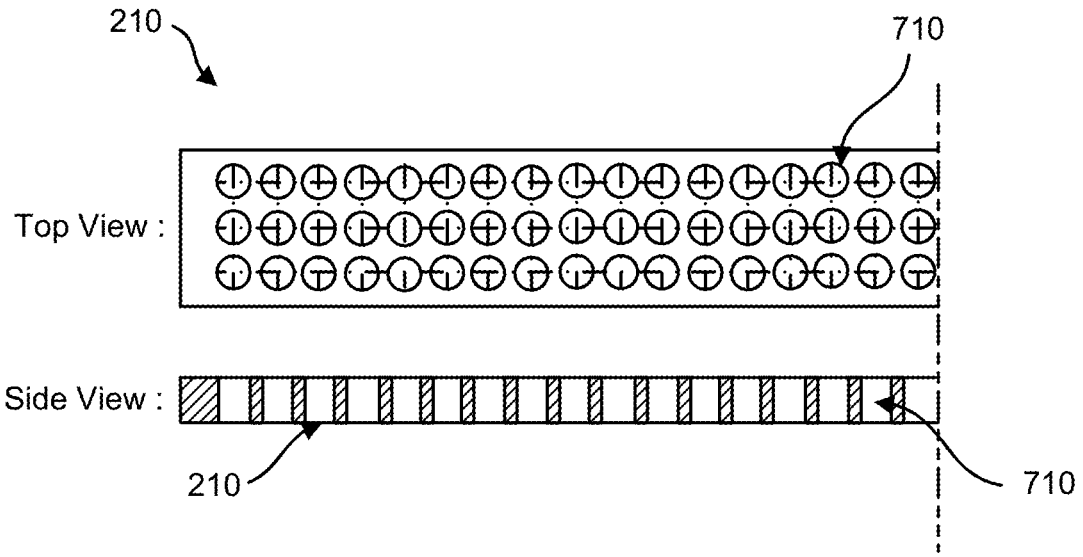
FIG. 7 includes a partial top view and a partial cross-sectional side view of the breaker plates used in an embodiment of the die tip assembly of FIG. 2.

FIG. 7 includes a partial top view and a partial cross-sectional side view of the breaker plates 210 used in the die tip assembly of FIG. 2. The breaker plate 210 governs (e.g., unifies, filters, and/or slows) polymer flow from the polymer flow passageway 330 of the mounting structure 112 into the polymer flow chamber 350 of the die tip 114. The breaker plate 210 includes a plurality of holes 710. The holes 710 may be arranged in various manners, such as staggered or in an array as shown. In certain implementations, the holes 710 may be cylindrical; in other instances, the holes 710 may be tapered or shaped to achieve polymer distribution and filter screen support. The plurality of cylindrical holes 710 limits the direction of the polymer flow to travel.

Figure 9:
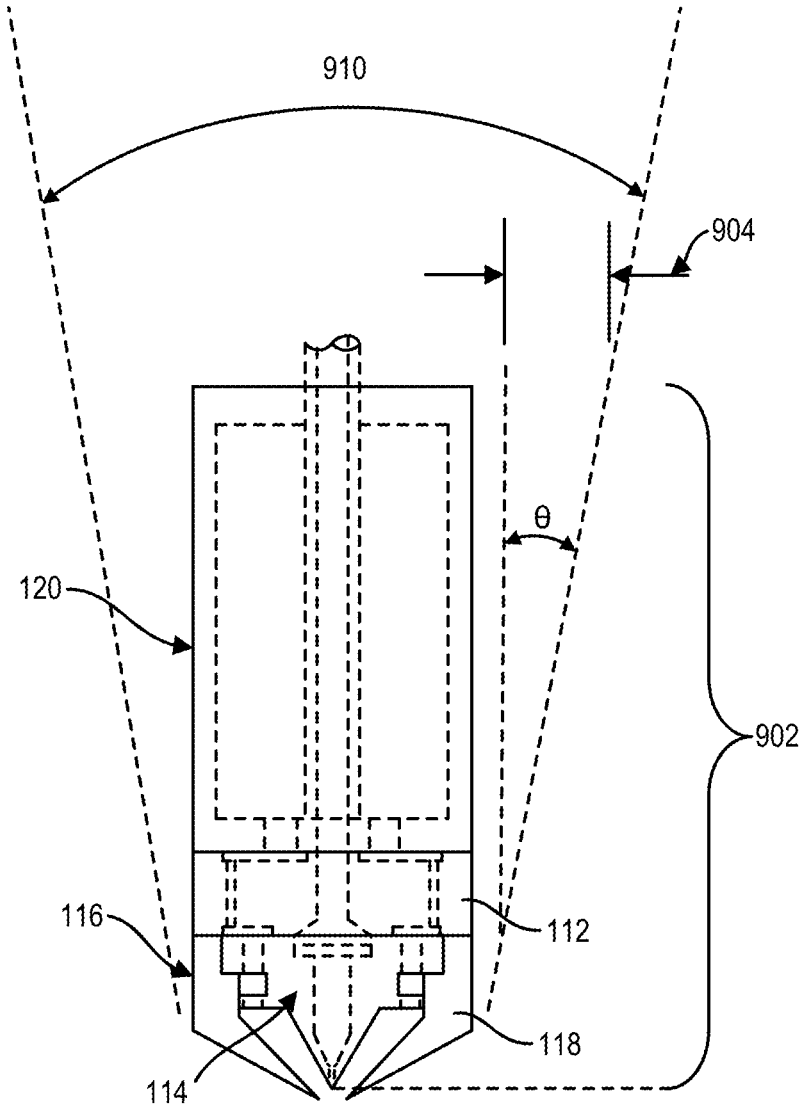
FIG. 9 is an illustrative front view of an implementation of a meltblown system illustrating a region of control.

FIG. 9 is an illustrative front view of an implementation of the meltblown system 100 showing space requirements. The meltblown beam 120, the mounting structure 112, and the die tip 114 form a height 902 such that no other obstacle interferes with the surrounding air of the die tip 114 in a region of control 910. The region of control 910 may be defined with an angle (θ) determined by the height above the die tip 114 and an offset distance 904. In some implementations, the region of control 910 may be no greater than 45 degrees. In some embodiments, the region of control 910 may be no greater than 30 degrees. The height 902 may be about 8 inches to about 30 inches. The offset distance 904 may be determined by the height above the die tip 114 and tan (θ). In some implementations, the offset distance 904 is about 0-12 inches. Such clearance requirement avoids potential negative airflow effect to the surrounding air around the entrainment point 430 shown in FIG. 4A.

Other implementations are possible. For example, although the meltblown process is commonly used for thermoplastic materials for producing non-woven fabric products, different polymers other than thermoplastic materials may be used with the disclosed equipment. For example, curable materials in their liquid form may be delivered onto a target substrate using the same apparatus or apparatus modified using the same working principles. In other instances, although the mounting structure 112 and the die tip 114 are illustrated as two separate structures, in other embodiments, they can be one integral structure to save additional sealing steps when the die tip 114 is fitted against the mounting structure 112. In some other embodiments, the die tip 114 and the first and the second air plates 116 and 118 may be fitted directly to the meltblown beam 120 without the intermediate mounting structure 112.

What is claimed is:

1. A meltblown die tip assembly comprising:

a mounting structure having at least one polymer flow passageway formed therein and configured to receive a polymer flow, a first air passageway formed therein and configured to receive a first airflow, and a second air passageway formed therein and configured to receive a second airflow;

an elongated die tip having a polymer flow chamber with a first opening and a second opening, a polymer flow tip, a first airflow regulation channel having a first transition surface provided as a part of the elongated die tip, a second airflow regulation channel having a second transition surface provided as a part of the elongated die tip, a first angled side, and a second angled side, wherein the first transition surface extends at least partially across a portion of the first airflow regulation channel, wherein the second transition surface extends at least partially across a portion of the second airflow regulation channel, wherein the polymer flow chamber of the elongated die tip is in fluid communication with the at least one polymer flow passageway of the mounting structure at the first opening of the polymer flow chamber of the elongated die tip, and the polymer flow chamber configured to receive at least a portion of the polymer flow from the at least one polymer flow passageway of the mounting structure, the polymer flow chamber of the elongated die tip in fluid communication with the polymer flow tip at the second opening, wherein the polymer flow tip of the elongated die tip is configured to receive at least a portion of the polymer flow from the polymer flow chamber at the second opening, the polymer flow tip having a tip opening configured to dispense at least a portion of the polymer flow, wherein the first airflow regulation channel of the elongated die tip is configured to receive the first airflow from the first air passageway of the mounting structure, regulate the first airflow using at least the first transition surface provided as a part of the elongated die tip, and dispense the first airflow adjacent the first angled side of the elongated die tip, wherein the second airflow regulation channel of the elongated die tip is configured to receive the second airflow from the second air passageway of the mounting structure, regulate the second airflow using at least the second transition surface provided as a part of the elongated die tip, and dispense the second airflow adjacent the second angled side of the elongated die tip;

a first air plate positioned at least partially adjacent the first angled side of the elongated die tip to form a first air exit passageway to receive the first airflow dispensed from the first airflow regulation channel of the elongated die tip and to dispense the first airflow adjacent the tip opening of the polymer flow tip and the at least a portion of the polymer flow; and a second air plate positioned at least partially adjacent the second angled side of the elongated die tip to form a second air exit passageway to receive the second airflow dispensed from the second airflow regulation channel of the elongated die tip and to dispense the second airflow adjacent the tip opening of the polymer flow tip and the at least a portion of the polymer flow;

wherein the first airflow and the second airflow assist with the polymer flow at the polymer flow tip, wherein the first airflow regulation channel comprises a plurality of transition surfaces provided as a part of the elongated die tip, and wherein at least one or more of the plurality of transition surfaces provided as a part of the elongated die tip extends the entire width of the first airflow regulation channel in one or more locations.

2. The meltblown die tip assembly of claim 1, wherein the elongated die tip includes an impingement portion housing the first airflow regulation channel and the second airflow regulation channel.

3. The meltblown die tip assembly of claim 2, wherein the elongated die tip includes a neck portion narrower than the impingement portion and obstructing airflows of the first airflow regulation channel and the second airflow regulation channel.

4. The meltblown die tip assembly of claim 2, wherein the impingement portion includes a plurality of fastenable holes for receiving fasteners affixing the first air plate and the second air plate to the impingement portion of the elongated die tip.

5. The meltblown die tip assembly of claim 4, wherein the elongated die tip is not threadedly connected to the mounting structure.

6. The meltblown die tip assembly of claim 1, wherein the elongated die tip and the first and the second air plates form a replaceable cartridge.

7. The meltblown die tip assembly of claim 1, further comprising at least one breaker plate governing polymer flow from the polymer flow passageway of the mounting structure into the polymer flow chamber.

8. The meltblown die tip assembly of claim 7, wherein the at least one breaker plate includes a plurality of holes for filtering and regulating the polymer flow.

9. The meltblown die tip assembly of claim 8, wherein the at least one breaker plate includes two stacked breaker plates having one or more screen filter positioned between the two stacked breaker plates.

10. The meltblown die tip assembly of claim 1, wherein the first air plate and the second air plate are mounted to the mounting structure using a plurality of fasteners parallel to a vertical axis of the polymer flow chamber.

11. The meltblown die tip assembly of claim 1, wherein the first airflow regulation channel is configured to receive the first airflow from the first air passageway of the mounting structure, regulate the first airflow, transfer heat from the first airflow to the elongated die tip, and dispense the first airflow adjacent the first angled side of the elongated die tip; and wherein the second airflow regulation channel is configured to receive the second airflow from the second air passageway of the mounting structure, regulate the second airflow, transfer heat from the second airflow to the elongated die tip, and dispense the second airflow adjacent the second angled side of the elongated die tip.

12. The meltblown die tip assembly of claim 11, wherein the first and the second airflows cause the die tip assembly to operate at a temperature range that maintains the polymer flow in a liquid state.

13. The meltblown die tip assembly of claim 1, wherein the polymer flow tip has an external angle of about 50 degrees to about 90 degrees.

14. The meltblown die tip assembly of claim 1, wherein the mounting structure and the elongated die tip are a unified piece.

15. The meltblown die tip assembly of claim 1, wherein the elongated die tip further comprises an angled tip, the first air plate further comprises a first tip, and the second air plate further comprises a second tip, such that a vertical distance between the angled tip and a midpoint of the first tip and the second tip defines a setback dimension being about 0.5 mm to about 4.0 mm.

16. The meltblown die tip assembly of claim 15, wherein a distance between the first tip and the second tip defines a tip-to-tip distance, such that a ratio of the setback dimension and the tip-to-tip distance is about 0.25 to about 2.5.

17. The meltblown die tip assembly of claim 1, wherein the at least one polymer flow passageway of the mounting structure includes an opening width near the first opening of the polymer flow chamber allowing access to internal surfaces of the at least one polymer flow passageway of the mounting structure.

18. The meltblown die tip assembly of claim 17, wherein the internal surfaces of the at least one polymer flow passageway of the mounting structure includes a tapered top surface for distributing the polymer flow.

19. The meltblown die tip assembly of claim 1, wherein the first air plate includes a first outer surface, the second air plate includes a second outer surface, wherein the first outer surface and the second outer surface form an angle between about 90 and about 180 degrees.

20. The meltblown die tip assembly of claim 19, wherein the first air plate includes a first outer surface, the second air plate includes a second outer surface, wherein the first outer surface and the second outer surface form an angle between about 90 and about 140 degrees.

21. The meltblown die tip assembly of claim 1, further comprising a meltblown beam fluidly connected with the mounting structure for supplying air and polymer, wherein the meltblown beam and the mounting structure form a height above the die tip such that no other obstacle interferes with the surrounding air of the die tip in a region of control defined by an angle determined by the height above the die dip and an offset distance.

22. The meltblown die tip assembly of claim 21, wherein the meltblown beam and the mounting structure are one unified piece.

23. The meltblown die tip assembly of claim 1, wherein the first airflow and the second airflow are entrained at a tip apex drawing the polymer flow and surrounding air such that no interfering structure is present within at least about 38 mm of the tip apex.

24. The meltblown die tip assembly of claim 1, wherein the polymer flow chamber of the elongated die tip includes a rib structure connecting a first side wall of the polymer flow chamber to a second, opposing, side wall of the polymer flow chamber, wherein the rib structure has a cross sectional fluid dynamic shape to promote laminar flow in the polymer flow.

25. The meltblown die tip assembly of claim 1, wherein the first transition surface provided as a part of the elongated die tip is located at or adjacent to a top surface of the elongated die tip.

26. The meltblown die tip assembly of claim 1, wherein the first transition surface provided as a part of the elongated die tip is located within the first airflow regulation channel.

27. The meltblown die tip assembly of claim 1, wherein the elongated die tip has an overall width between 1.0 to 5.5 meters and the polymer flow tip is repeated at about 25 to 100 polymer flow tips per inch along the overall width.

28. The meltblown die tip assembly of claim 27, wherein the polymer flow tip has a diameter of about 0.05 mm to about 1.00 mm.

29. The meltblown die tip assembly of claim 27, wherein the first airflow and the second airflow converge to produce an output airflow spanning the overall width of the elongated die tip, wherein the output airflow has a uniformity level such that a flow rate near an end of the elongated tip is greater than or equal to 97.5% of an average flow rate of the output airflow.

30. The meltblown die tip assembly of claim 1, wherein the second airflow regulation channel further comprises a pluarlity of transition surfaces provided as a part of the elongated die tip.

31. The meltblown die tip assembly of claim 30, wherein at least one of the plurality of transition surfaces provided as a part of the elongated die tip extends the entire width of the second airflow regulation channel in a plurality of locations.

32. The meltblown die tip assembly of claim 1, wherein the first transition surface and the second transition surface are each substantially flat.

33. The meltblown die tip assembly of claim 1, wherein the first transition surface provided as a part of the elongated die tip is located between a top surface of the elongated die tip and the first air exit passageway.

34. An elongated die tip comprising:

a body portion, a polymer flow chamber, a polymer flow tip, a first airflow regulation channel, a first angled side, a second airflow regulation channel, and a second angled side opposed to the first angled side, the first angled side and the second angled side positioned adjacent the polymer flow tip, wherein the polymer flow chamber is configured to receive a polymer flow and to deliver the polymer flow to the polymer flow tip, wherein the first airflow regulation channel of the elongated die tip is configured to receive a first airflow, regulate the first air flow, and to deliver the first airflow adjacent the first angled side;

wherein the body portion includes at least a portion of the first airflow regulation channel with at least one transition surface provided as a part of the elongated die tip, the at least one transition surface is configured to impinge the first airflow to regulate the first airflow;

wherein the at least one transition surface extends at least partially across the first airflow regulation channel; and wherein the first angled side is positioned adjacent the polymer flow tip such that the first airflow draws out the polymer flow from the polymer flow tip, and wherein the body portion includes a narrow neck portion such that a second transition surface from the neck portion impedes the first airflow exiting the first airflow regulation channel to the first angled side.

35. An elongated die tip comprising:

a body portion, a polymer flow chamber, a polymer flow tip, a first airflow regulation channel, a first angled side, a second airflow regulation channel, and a second angled side opposed to the first angled side, the first angled side and the second angled side positioned adjacent the polymer flow tip, wherein the polymer flow chamber is configured to receive a polymer flow and to deliver the polymer flow to the polymer flow tip, wherein the first airflow regulation channel of the elongated die tip is configured to receive a first airflow, regulate the first air flow, and to deliver the first airflow adjacent the first angled side;

wherein the body portion includes at least a portion of the first airflow regulation channel with at least one transition surface provided as a part of the elongated die tip, the at least one transition surface is configured to impinge the first airflow to regulate the first airflow;

wherein the at least one transition surface extends at least partially across the first airflow regulation channel, and wherein the first angled side is positioned adjacent the polymer flow tip such that the first airflow draws out the polymer flow from the polymer flow tip, wherein the first angled side of the elongated die tip is adjacent a first air plate for directing and accelerating the first airflow impeded by the at least one transition surface.

36. The elongated die tip of claim 35, wherein the first airflow heats up the body portion when the at least one transition surface impinges the airflow to assist with heat transfer from the first and second air flows to the elongated die tip.

37. The elongated die tip of claim 35, wherein the second airflow regulation channel receives a second airflow and provides the second airflow adjacent the second angled side.

38. The elongated die tip of claim 37, wherein the body portion includes a second transition surface impinging the second airflow for regulating the second airflow in the second air regulation channel.

39. The elongated die tip of claim 38, wherein the second airflow is accelerated to a substantially same level of speeds as the first airflow when reached at the polymer flow tip such that both the first airflow and the second airflow are entrained to draw and blow out the polymer from the polymer flow tip.

40. The elongated die tip of claim 39, wherein the first airflow and the second airflow are not impeded by or in contact with any fastener when the first airflow travels from the first airflow regulation channel to reach the polymer flow tip and the second airflow travels from the second airflow regulation channel to reach the polymer flow tip.

41. The elongated die tip of claim 40, wherein the first airflow and the second airflow are not impeded for at least 38 mm away from the polymer flow tip.

42. The elongated die tip of claim 40, wherein the first air plate further includes a first tip, and the second air plate further includes a second tip, such that a vertical distance between the polymer flow tip and a midpoint of the first tip and the second tip defines a setback dimension being about 0.5 mm to 4.0 mm.

43. The elongated die tip of claim 42, wherein a distance between the first tip and the second tip defines a tip-to-tip distance, such that a ratio of the setback dimension and the tip-to-tip distance is about 0.25 to 2.5.

44. The elongated die tip of claim 35, wherein the elongated die tip provides threadedly connection to a first air plate and a second air plate.

45. A meltblown die tip assembly comprising:

a mounting structure having a polymer flow conduit and an airflow conduit;

a die tip sealingly attached to the mounting structure, the die tip receiving a polymer flow from the polymer flow conduit of the mounting structure, and receiving an airflow from the airflow conduit of the mounting structure, wherein the die tip includes a first transition surface provided as a part of an airflow channel of the die tip for receiving and reflecting the airflow to force the airflow to reassemble, a narrow neck portion such that a second transition surface from the neck portion impedes the first airflow exiting the first airflow regulation channel to the first angled side, and a polymer flow tip for providing the polymer from the meltblown die tip assembly;

wherein the first transition surface and the second transition surface extends at least partially across the airflow conduit; and an air plate attached to the mounting structure positioned beside the die tip to form an airflow passage to provide the airflow exiting the meltblown die tip assembly adjacent the polymer flow tip, wherein the airflow draws the polymer flow from the polymer flow tip and fiberizes at least a portion of the polymer flow.

* * * * *